US010287651B2

(12) United States Patent
Choo et al.

(10) Patent No.: US 10,287,651 B2
(45) Date of Patent: May 14, 2019

(54) THERMAL REDUCTION APPARATUS FOR METAL PRODUCTION, GATE DEVICE, CONDENSING SYSTEM, AND CONTROL METHOD THEREOF

(71) Applicant: RESEARCH INSTITUTE OF INDUSTRIAL SCIENCE & TECHNOLOGY, Pohang (KR)

(72) Inventors: Dong Kyun Choo, Pohang (KR); Young Il Kim, Pohang (KR); Kil Won Cho, Pohang (KR); Wung Yong Choo, Pohang (KR); Jong Min Park, Pohang (KR); Jae Sin Park, Gangneung (KR); Gilsoo Han, Gangneung (KR); Good-Sun Choi, Gangneung (KR); Gyu Chang Lee, Gangneung (KR); Dae Kyu Park, Gangneung (KR); Moon Chul Kim, Seoul (KR)

(73) Assignee: RESEARCH INSTITUTE OF INDUSTRIAL SCIENCE & TECHNOLOGY, Pohang-si (KR)

( * ) Notice: Subject to any disclaimer, the term of this patent is extended or adjusted under 35 U.S.C. 154(b) by 387 days.

(21) Appl. No.: 14/794,015

(22) Filed: Jul. 8, 2015

(65) Prior Publication Data

US 2016/0069615 A1 Mar. 10, 2016

(30) Foreign Application Priority Data

Sep. 4, 2014 (KR) ..... 10-2014-0117736
Dec. 22, 2014 (KR) ..... 10-2014-0186441
(Continued)

(51) Int. Cl.
*F27B 19/02* (2006.01)
*C22B 1/00* (2006.01)
(Continued)

(52) U.S. Cl.
CPC ..... *C22B 5/16* (2013.01); *C22B 26/22* (2013.01); *F27B 9/028* (2013.01); *F27B 9/042* (2013.01);
(Continued)

(58) Field of Classification Search
CPC ... C22B 5/16; C22B 26/22; F27B 2017/0091; F27B 9/028; F27B 9/042; F27B 9/2407;
(Continued)

(56) References Cited

U.S. PATENT DOCUMENTS 3,615,927 A * 10/1971 Paulson ..... C21D 1/70 148/587
4,441,698 A * 4/1984 Limque ..... C21D 9/22 266/124
(Continued)

FOREIGN PATENT DOCUMENTS

CN 1127792 7/1996
CN 101157989 4/2008
(Continued)

OTHER PUBLICATIONS

Office Action, Korea Intellectual Property Office, Application No. 10-2014-0186441, dated Jan. 12, 2016.
(Continued)

*Primary Examiner* — Scott R Kastler
*Assistant Examiner* — Michael Aboagye
(74) *Attorney, Agent, or Firm* — Lex IP Meister, PLLC

(57) ABSTRACT

Disclosed is a thermal reduction apparatus. The thermal reduction apparatus according to the exemplary embodiment includes: a preheating unit which preheats a to-be-reduced material and loads the to-be-reduced material into a reducing unit; the reducing unit which is connected to the preheating unit and in which a thermal reduction reaction of the to-be-reduced material occurs; a cooling unit which is
(Continued)

connected to the reducing unit and from which the to-be-reduced material flowing into the cooling unit is unloaded to the outside; a gate device which is installed between the preheating unit and the reducing unit; a gate device which is installed between the reducing unit and the cooling unit; a condensing device which is connected to the reducing unit and condenses a metal vapor; a first blocking unit which is installed in the reducing unit; and a second blocking unit which is installed in the reducing unit so as to be spaced apart from the first blocking unit.

6 Claims, 36 Drawing Sheets

(30) Foreign Application Priority Data

Dec. 22, 2014 (KR) ..... 10-2014-0186547
Dec. 23, 2014 (KR) ..... 10-2014-0187655

(51) Int. Cl.

| | |
|---|---|
| ***C22B 9/04*** | (2006.01) |
| ***F27D 13/00*** | (2006.01) |
| ***F27D 15/02*** | (2006.01) |
| ***C22B 5/16*** | (2006.01) |
| ***F27D 7/06*** | (2006.01) |
| ***C22B 26/22*** | (2006.01) |
| ***F27D 3/04*** | (2006.01) |
| ***F27D 3/12*** | (2006.01) |
| ***F27D 99/00*** | (2010.01) |
| ***F27B 9/02*** | (2006.01) |
| ***F27B 9/04*** | (2006.01) |
| ***F27B 9/24*** | (2006.01) |
| ***F27B 9/40*** | (2006.01) |
| *F27B 17/00* | (2006.01) |

(52) U.S. Cl.
CPC ..... *F27B 9/2407* (2013.01); *F27B 9/40* (2013.01); *F27D 3/04* (2013.01); *F27D 3/12* (2013.01); *F27D 99/0073* (2013.01); *F27B 2017/0091* (2013.01); *F27D 7/06* (2013.01)

(58) Field of Classification Search
CPC ..... F27B 9/40; F27D 3/04; F27D 3/12; F27D 7/06; F27D 99/0073
USPC ..... 266/249; 75/401
See application file for complete search history.

(56) References Cited

U.S. PATENT DOCUMENTS 4,518,353 A * 5/1985 Banno ..... F27B 5/04 432/152
5,205,857 A * 4/1993 Yokoyama ..... C22B 19/04 75/401
5,735,933 A * 4/1998 Yokoyama ..... C22B 5/16 429/49

FOREIGN PATENT DOCUMENTS

| | | |
|---|---|---|
| CN | 102105608 | 6/2011 |
| EP | 0493122 | 7/1992 |
| JP | 07-003343 | 1/1995 |
| JP | 2007-137714 | 6/2007 |
| KR | 10-0363813 | 2/2003 |
| KR | 10-2004-0027347 | 4/2004 |
| KR | 10-2007-0017059 | 2/2007 |
| KR | 10-0767071 | 10/2007 |
| KR | 10-2012-0074927 | 7/2012 |
| KR | 10-2012-0074972 | 7/2012 |
| KR | 10-2012-0100018 | 9/2012 |
| KR | 10-2013-0075506 | 7/2013 |
| KR | 10-2013-0076253 | 7/2013 |
| KR | 10-2013-0081768 | 7/2013 |
| KR | 10-2013-0081779 | 7/2013 |
| KR | 10-2014-0084476 | 7/2014 |

OTHER PUBLICATIONS

Office Action, Korea Intellectual Property Office, Application No. 10-2014-0186547, dated Jan. 12, 2016.
Office Action, Korea Intellectual Property Office, Application No. 10-2014-0117736, dated Jan. 18, 2016.
Notice of Allowance, Korean Intellectual Property Office, Application No. 10-2014-0186441, dated Apr. 21, 2016.
Notice of Allowance, Korean Intellectual Property Office, Application No. 10-2014-0186547, dated Apr. 21, 2016.

* cited by examiner

THERMAL REDUCTION APPARATUS FOR METAL PRODUCTION, GATE DEVICE, CONDENSING SYSTEM, AND CONTROL METHOD THEREOF

CROSS-REFERENCE TO RELATED APPLICATION

This application claims priority to and the benefit of Korean Patent Application Nos. 10-2014-0117736, 10-2014-0186547, 10-2014-0186441, and 10-2014-187655 filed in the Korean Intellectual Property Office on Sep. 4, 2014, Dec. 22, 2014, Dec. 22, 2014, and Dec. 23, 2014, the entire contents of which are incorporated herein by reference. In addition, the entire contents of Korean Patent Application No. 10-2013-0159587 filed in the Korean Intellectual Property Office on Dec. 19, 2013 is incorporated herein by reference.

BACKGROUND OF THE INVENTION (a) Field of the Invention

The present invention relates to a thermal reduction apparatus for metal production, a gate device of the thermal reduction apparatus, a condensing system of the thermal reduction apparatus, and a control method thereof.

(b) Description of the Related Art

A method of refining metal may be classified into pyrometallurgy, hydrometallurgy, electrometallurgy, and chlorine refining, and in the case of iron and most nonferrous metals, pure metal is obtained through the pyrometallurgy.

In a general pyrometallurgy process for nonferrous metal, metal, which is sintered in the form of a briquette, is heated at normal pressure or under a vacuum environment at a high temperature, and the pure metal is thermally reduced.

In order to refine magnesium metal using a thermal reduction method, briquettes mixed with reductants such as fired dolomite and ferrosilicon are loaded into a cylindrical retort made of metal, and the briquettes are heated at a high temperature.

When pressure in the retort is maintained in a vacuum state simultaneously with the heating, a magnesium oxide is reduced by the silicon, and magnesium vapor is generated.

The magnesium vapor is transferred by a vacuum pump to a condensing pipe installed at one side of the retort, and then begins to be condensed from an inner wall surface of the condensing pipe by thermophoresis (temperature), and magnesium is gradually accumulated in a central direction.

After the generation and condensation of the magnesium vapor are completed, the condensing pipe on which the magnesium is condensed is separated from the retort, thereby recovering the magnesium.

However, in the case of this batch type of manufacturing apparatus, there is a limitation in that productivity per day is limited because the reduction is carried out for a predetermined time, a thermal loss occurs in the retort because of discontinuous loading and unloading, and there is difficulty in automating processes consistently, and as a result, there is a need for a method of continuously and thermally reducing the magnesium.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a thermal reduction apparatus which thermally reduces a metal.

The present invention has also been made in an effort to provide a thermal reduction apparatus for metal production and a control method thereof which may continuously produce a metal, thereby improving efficiency in producing a metal, and reducing costs required to produce a metal.

The present invention has also been made in an effort to provide a gate device, which is installed between a preheating chamber, a reducing chamber, and a cooling chamber, and may move a to-be-reduced material while stably maintaining a vacuum state at a high temperature without contamination caused by reduced metal vapor, and a thermal reduction apparatus for metal production including the same.

The present invention has also been made in an effort to provide a condensing device which may prevent a metal from being condensed in a chamber and may continuously produce metal crowns, thereby reducing costs required to produce a metal and improving production efficiency, and a thermal reduction apparatus for metal production including the same.

An exemplary embodiment of the present invention provides a thermal reduction apparatus including: a preheating unit which preheats a to-be-reduced material and loads the to-be-reduced material into a reducing unit; the reducing unit which is connected to the preheating unit and in which a thermal reduction reaction of the to-be-reduced material occurs; a cooling unit which is connected to the reducing unit and from which the to-be-reduced material flowing into the cooling unit is unloaded to the outside; a first gate device which is installed between the preheating unit and the reducing unit; a second gate device which is installed between the reducing unit and the cooling unit; and a condensing device which is connected to the reducing unit and condenses a metal vapor.

Another exemplary embodiment of the present invention provides a thermal reduction apparatus including: a preheating unit which preheats a to-be-reduced material; a reducing unit which is connected to the preheating unit and in which a thermal reduction reaction of the to-be-reduced material occurs; a cooling unit which is connected to the reducing unit and from which the to-be-reduced material flowing into the cooling unit is unloaded to the outside; a first gate valve which is installed between the preheating unit and the reducing unit; a second gate valve which is installed between the reducing unit and the cooling unit; a condensing device which is connected to the reducing unit and condenses a metal vapor; and a loader which is installed at a lateral side of the preheating unit and moves the to-be-reduced material from the preheating unit to the reducing unit.

The thermal reduction apparatus may include: a first blocking unit which is installed in the reducing unit; and a second blocking unit which is installed in the reducing unit so as to be spaced apart from the first blocking unit.

The first gate device and the second gate device may include inert gas inlets which are formed while penetrating one surface of the body.

The gate device may further include a vacuum device.

The reducing unit may include: a reducing unit body which includes a third opening, and a fourth opening formed at a position opposite to the third opening; and the first blocking unit and the second blocking unit which are installed in the reducing unit body, in which the first blocking unit is positioned between the first gate device and the second blocking unit.

The reducing unit may include: a first space which is formed in the reducing unit body between the first gate device and the first blocking unit; a second space which is formed between the first blocking unit and the second blocking unit; and a third space which is formed between the second blocking unit and the second gate device, and the condensing device may be connected to the second space.

The first space and the third space may include inert gas inlets which are formed while penetrating the reducing unit body.

The first space and the third space may further include condensing devices which are installed while penetrating the reducing unit body. The thermal reduction apparatus may further include a vacuum device connected to the condensing device.

A temperature in the second space may be maintained to be higher than temperatures in the first space and the third space. The second space may be maintained at a temperature of 1100° C. to 1300° C., and the first space and the third space may be maintained at a temperature of 800° C. to 1000° C.

The first blocking unit and the second blocking unit may be made of graphite.

The preheating unit may include: a preheating unit body which has a first opening, and a second opening formed opposite to the first opening; a first door which is openably and closably coupled to the first opening; a vacuum device which is installed while penetrating one surface of the preheating unit body; and a temperature adjusting device which is installed in the preheating unit body and preheats the to-be-reduced material.

The cooling unit may include: a cooling unit body which has a fifth opening, and a sixth opening formed opposite to the fifth opening; a second door which is openably and closably coupled to the sixth opening; and at least one vacuum device which is installed while penetrating one surface of the cooling unit body.

In addition, a conduit, which connects the reducing unit and the preheating unit, may be installed.

In addition, the thermal reduction apparatus may further include a conveying device for conveying the to-be-reduced material.

The preheating unit may be disposed at a lateral side of the reducing unit with respect to the movement direction of the to-be-reduced material, and the loader may move the to-be-reduced material to the first space through a lateral side of the reducing unit body.

The loader may include a first drive cylinder which is installed to the preheating unit and pushes the to-be-reduced material toward the first space while being extended toward the first space of the reducing unit body.

A rail member, which is placed along the preheating unit and the first space of the reducing unit body so that the to-be-reduced material is movable, may be further installed.

The thermal reduction apparatus may include a moving unit which is installed to the reducing unit and continuously moves the to-be-reduced material moved to the reducing unit, along the reducing unit.

The moving unit may include a second drive cylinder which is installed at a tip of the first space of the reducing unit body and pushes the to-be-reduced material moved to the first space toward the second space of the reducing unit body while being extended toward the second space.

The moving unit may further include rollers which are disposed along the second space at intervals and installed to be freely rotatable so that the to-be-reduced material is placed and moved on the rollers.

The moving unit may further include a third drive cylinder which is installed at a tip of the third space of the reducing unit body and draws the to-be-reduced material in the second space toward the third space while being extended toward the second space.

The thermal reduction apparatus may further include a drawer which is installed at a lateral side of the third space of the reducing unit body and moves the to-be-reduced material moved to the third space toward the cooling unit.

The cooling unit may be disposed at a lateral side of the reducing unit with respect to the movement direction of the to-be-reduced material, and the drawer may move the to-be-reduced material to the cooling unit through a lateral side of the third space of the reducing unit body.

The drawer may include a fourth drive cylinder which is installed at the lateral side of the third space and pushes the to-be-reduced material in the third space toward the cooling unit while being extended toward the cooling unit.

In addition, the preheating unit and the reducing unit may include at least one temperature adjusting device.

In addition, the preheating unit, the reducing unit, and the cooling unit may include at least one vacuum device.

The to-be-reduced material may be a fired body produced when a magnesium briquette is fired together with a reductant.

The first gate device or the second gate device may include: a valve housing which is installed on a movement route of the to-be-reduced material and defines an internal space; valve body members which are installed in the valve housing and have a passage through which the to-be-reduced material passes; and a valve door unit which is movably installed in the valve housing and selectively comes into close contact with the valve body members to open and close the passage.

The valve body member may include: a frame which forms a passage; a sealing member which is installed along a circumference of the frame so as to be spaced apart from the frame and comes into close contact with the valve door unit to maintain air-tightness; and a blocking unit which selectively blocks a portion between a groove in which the sealing member is installed and the inside of the valve housing.

The blocking unit may include a first curtain which is rotatably installed in the valve body member and blocks the groove in which the sealing member is installed.

The blocking unit may further include a second curtain which is installed between the sealing member and the first curtain and blocks the groove.

The blocking unit may further include: a space which is formed in the valve body member so that the second curtain is moved in the space; a spring which is installed in the space and applies elastic force to the second curtain; and a cooperating bar which is formed on the first curtain, abuts the second curtain, and pushes and moves the second curtain when the first curtain is rotated.

The blocking unit may further include: a gas pipe through which an inert gas is injected to the groove in which the sealing member is installed; and a gas supply unit which supplies the inert gas to the injection pipe.

The valve body member may further include a thermal resistance unit which is installed between the frame and the sealing member and forms a temperature gradient in the internal space of the valve housing so as to block the reduced vapor from being moved toward the sealing member.

The thermal resistance unit may include a heating wire which is installed in the valve body member and forms a high-temperature region.

The thermal resistance unit may include a primary coolant pipe and a secondary coolant pipe which are spaced apart from the heating wire and installed inside and outside at the periphery of the heating wire so as to form a low-temperature region.

The valve door unit may include: a vertical cylinder which is installed at an upper end of the valve housing; a vertical beam which is connected to the vertical cylinder and moved upward and downward in the valve housing; door plates which are installed on the vertical beam and come into close contact with the valve body members while being moved in a horizontal direction toward the valve body members; and a close contact member which protrudes from the door plate and is moved into the groove in which the sealing member is installed so as to come into close contact with the sealing member.

The valve door unit may further include a skimmer which is installed on the door plate and fitted into the frame so as to scrape reduced metal condensed on an inner circumferential surface of the frame off the inner circumferential surface.

The gate device may further include a cooling jacket installed in the door plate.

A condensing system of the thermal reduction apparatus may include a single condensing device or a plurality of condensing devices which condense metal vapor at a tip of a condenser, and produce a metal crown.

The condensing system may have the plurality of condensing devices, and may include: branch pipes which supply the metal vapor to the plurality of condensing devices; control valves which are installed in the branch pipes connected to the condensing devices and control flows of the metal vapor; and a control unit which controls opened states of the control valves in accordance with whether condensing processes are carried out in the respective condensing devices, so as to adjust a movement direction of the metal vapor, and closes the control valve of the condensing device, in which the condensing process is not being carried out, so as to block an inflow of the metal vapor.

The control unit may measure a weight of the metal crown condensed on the condenser, and when the weight of the metal crown exceeds a set value, the control unit may move the condenser to a position for removing the metal crown.

The control unit may be on standby for a predetermined time until all residual metal vapor remaining in the branch pipe in which the control valve is closed is condensed, and thereafter, may move the condenser to the position for removing the metal crown.

The control unit may set condensing periods of the respective condensing devices to be different from each other, and may control the condensing process and the process of removing the metal crown to be continuously and alternately carried out.

The control valves are configured as vacuum valves, respectively, and the control unit may vary opening degrees of the control valves to adjust a flow rate of metal vapor flowing through each of the branch pipes and a period of time for which the condensing process is carried out.

The condensing device may include: an inlet pipe into which the metal vapor flows; a metal collecting chamber which is coupled to the inlet pipe; a condenser which is positioned at one end of the inlet pipe and has one end positioned at the inlet pipe and the other end that is positioned opposite to the one end and installed while penetrating the metal collecting chamber; a housing which is coupled to an opening of the metal collecting chamber and in which the other end of the condenser is positioned; a metal weight measuring unit which is installed between the condenser and the housing and measures a weight of the metal crown condensed at the one end of the condenser; and a condenser moving unit which is installed at one end of the housing and coupled to the condenser, and moves the condenser.

The metal weight measuring unit may include: a sleeve which is coupled to an outer circumferential surface of the condenser; a swinging shaft which connects the sleeve and the housing; and a load cell which is coupled to the sleeve, receives the swing movement of the condenser that swings about the swinging shaft, and measures a weight of the metal crown.

The housing may include a housing flange coupled to the metal collecting chamber, and the swinging shaft may be swingably installed between the housing flange and the sleeve.

The housing may further include: a housing main body from which the housing flange extends; and an intermediate member which is coupled to the housing main body so that one surface thereof is in contact with the load cell, and transmits the swing movement of the swinging shaft to the load cell.

The metal weight measuring unit may further include a bellows installed between the housing flange and the sleeve.

The metal weight measuring unit may further include a control unit which is connected to the load cell, receives the weight of the metal crown measured by the load cell, and controls the condenser moving unit.

The metal weight measuring unit may further include a scraper which is installed while penetrating the metal collecting chamber and separates the metal crown from the one end of the condenser.

The scraper may be connected to the control unit.

The condenser and the condenser moving unit may be connected through a condenser articulated joint installed on the condenser and a moving unit articulated joint installed on the condenser moving unit.

The inlet pipe may include a heater installed on an outer circumferential surface of the inlet pipe.

The condenser moving unit may move the condenser forward depending on a control signal from the control unit so as to move the condenser to a metal vapor condensing position in the inlet pipe, and move the condenser to a position for removing the metal crown by retracting the condenser.

A heater may be installed on an outer circumferential surface of the branch pipe and may heat the metal vapor flowing into the condensing device.

The condenser may have a coolant supply and discharge line, thereby cooling the metal condensing device at the tip of the condenser.

Yet another exemplary embodiment of the present invention provides a method of controlling a condensing system which includes a plurality of condensing devices that condense a metal vapor at a tip of a condenser and produce a metal crown, the method including: a) positioning condensers of the respective condensing devices to condensing positions in metal vapor inlet pipes; b) allowing metal vapor to flow into the inlet pipes by opening all control valves installed in branch pipes; c) measuring weights of metal crowns condensed at tips of the respective condensers; d)

blocking an inflow of the metal vapor by closing a control valve of a first condensing device when the weight of the metal crown measured in the first condensing device exceeds a set value; and e) moving the condenser of the first condensing device to a position for removing the metal crown and separating the metal crown.

In addition, step b) may include adjusting the control valves to vary points of time at which the metal vapor begins to flow into the respective condensing devices, or varying opening degrees of the respective control valves to vary periods for which the condensing process and the process of removing the metal crown are carried out.

The method may further include: between step d) and step e), waiting for a predetermined time until residual metal vapor remaining in the branch pipe of the first condensing device is consumed while being condensed.

The method may further include: after step e), moving the first condenser, from which the metal crown is separated, to a condensing position in the corresponding inlet pipe; and allowing the metal vapor to flow again by opening the control valve of the first condensing device.

Still another exemplary embodiment of the present invention provides a metal condensing system of a thermal reduction apparatus, including: a plurality of condensing devices which condense metal vapor at a tip of a condenser, and produce a metal crown; a chamber which accommodates the plurality of condensing devices in parallel and shares a discharge passage for the metal crown; a branch pipe which forms a space unit that covers a plurality of inlet pipes that are configured in parallel at one side of the chamber, and allows metal vapor to flow into the respective inlet pipes; control valves which are installed in the space unit and open and close inlets of the respective inlet pipes while being moved rectilinearly; and a control unit which controls opened and closed states of the control valves in accordance with whether condensing processes are carried out in the respective condensing devices, so as to adjust a movement direction of the metal vapor, and closes the control valve of the condensing device in which the condensing process is not being carried out, so as to block an inflow of the metal vapor.

In addition, the control valve may include: a head portion which is made of a refractory material, has a predetermined inclination identical to an inclination of the inlet of the inlet pipe, and blocks the corresponding inlet of the inlet pipe; and a rectilinear motion mechanism which rectilinearly moves the head portion depending on a control signal.

The plurality of condensing devices may discharge the metal crown to a single metal crown discharge pipe through a shared discharge passage.

The to-be-reduced materials may be continuously supplied to the reducing unit, thereby continuously and thermally reducing a metal. Therefore, the to-be-reduced materials are continuously and thermally reduced, thereby maximizing productivity.

In addition, in a case in which the heating is carried out at the outside using a retort, there is a problem in that the retort is damaged due to heat. However, in the case of the thermal reduction apparatus according to the exemplary embodiment, the to-be-reduced material is heated in the thermal reduction apparatus, thereby increasing a lifespan of the thermal reduction apparatus.

In addition, it is possible to stably open and close the gate under vacuum at a high temperature, and to prevent contamination or damage to the sealing member of the gate due to the metal vapor of the reducing unit.

Further, it is possible to improve efficiency in producing magnesium by simplifying a magnesium process, and to reduce costs required to produce magnesium by allowing the magnesium condenser to be used repeatedly.

By using the plurality of condensing devices, the magnesium vapor is condensed and the magnesium vapor is controlled by the control valve so as to flow only into the condensing device in which the condensing process is being carried out, thereby preventing contamination in the condensing device and reducing consumption of the magnesium vapor.

In addition, the plurality of condensing devices alternately and continuously perform the condensing process and the process of removing the magnesium crown, thereby improving efficiency in producing the magnesium crown.

DETAILED DESCRIPTION OF THE EMBODIMENTS

Figure 1:
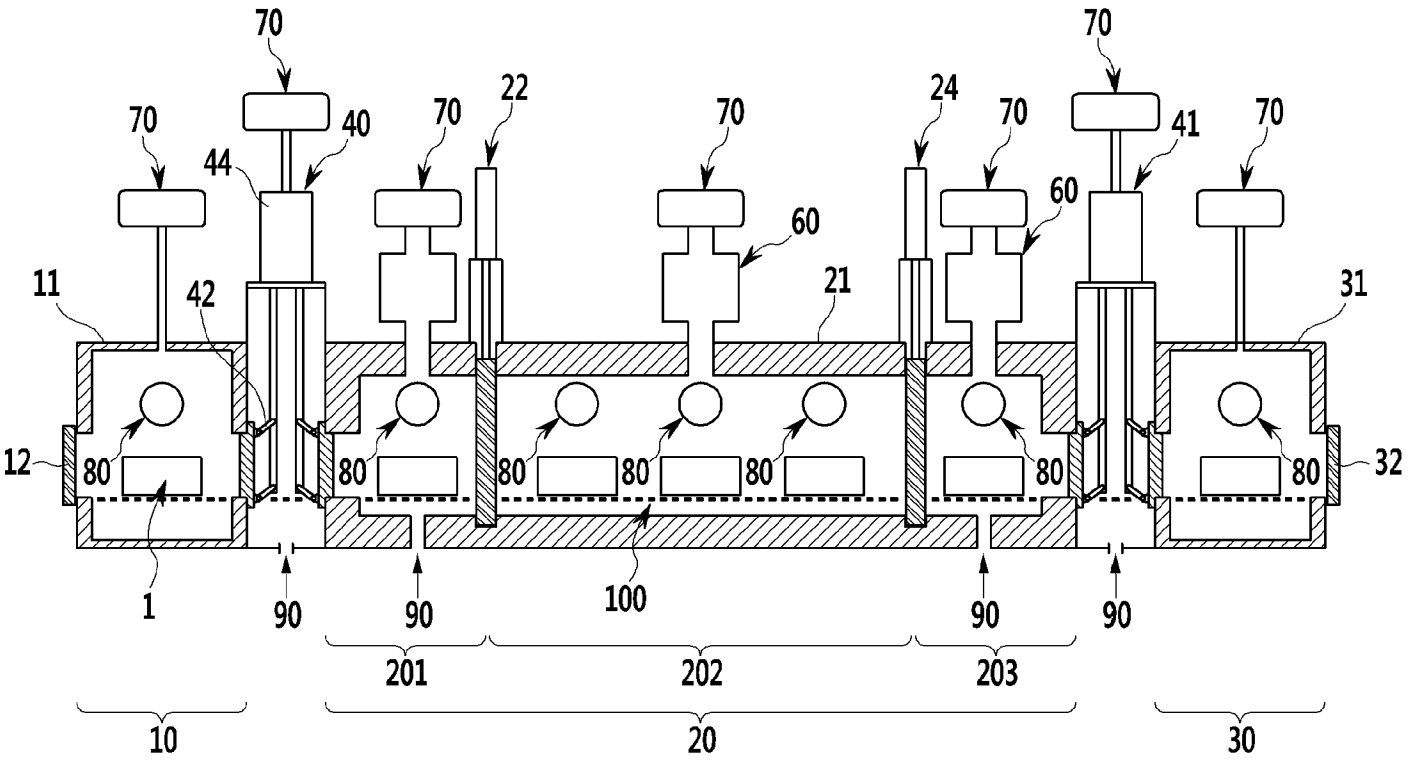
FIG. 1 is a configuration diagram of a thermal reduction apparatus according to an exemplary embodiment.

Advantages and features of the present disclosure and methods of achieving the advantages and features will be clear with reference to exemplary embodiments described in detail below together with the accompanying drawings. However, the present invention is not limited to the exemplary embodiments set forth below, and may be embodied in various other forms. The present exemplary embodiments are for rendering the disclosure of the present invention complete and are set forth to provide a complete understanding of the scope of the invention to a person with ordinary skill in the technical field to which the present invention pertains, and the present invention will only be defined by the scope of the claims. Like reference numerals indicate like elements throughout the specification.

Therefore, in several exemplary embodiments, well-known technologies will not be specifically described to avoid obscuring the present invention. Unless otherwise defined herein, all terms (including technical or scientific terms) used in the present specification have the meanings that are generally understood by those skilled in the art. Unless explicitly described to the contrary, the word "comprise" and variations such as "comprises" or "comprising" will be understood to imply the inclusion of stated elements but not the exclusion of any other elements. In addition, singular expressions used herein may include plural expressions unless specifically stated otherwise.

First Exemplary Embodiment

FIG. 1 is a configuration diagram of a thermal reduction apparatus according to an exemplary embodiment of the present invention.

Referring to FIG. 1, the thermal reduction apparatus according to the present exemplary embodiment may include: a preheating unit 10 which preheats a to-be-reduced material 1 and loads the to-be-reduced material 1 into a reducing unit 20; the reducing unit 20 which is connected to the preheating unit 10 and in which a thermal reduction reaction of the to-be-reduced material occurs; a cooling unit 30 which is connected to the reducing unit 20 and which unloads the to-be-reduced material 1 loaded into the cooling unit 30 to the outside; a first gate device 40 which is installed between the preheating unit 10 and the reducing unit 20; a second gate device 41 which is installed between the reducing unit 20 and the cooling unit 30; and a condensing device 60 which is connected to the reducing unit 20 and which condenses a metal vapor. The thermal reduction apparatus may also include: a first blocking unit 22 which is installed in the reducing unit; and a second blocking unit 24 which is installed in the reducing unit 20 so as to be spaced apart from the first blocking unit 22.

The preheating unit 10 may include: a preheating unit body 11 which has a first opening, and a second opening formed opposite to the first opening; a first door 12 which is openably and closably coupled to the first opening; a vacuum device 70 which is installed while penetrating one surface of the preheating unit body 11; and a temperature adjusting device 80 which is installed in the preheating unit body 11 and preheats the to-be-reduced material 1. In addition, the second opening may be opened and closed by the first gate device 40.

In the preheating unit 10, the temperature adjusting device 80 may be installed in the preheating unit body 11 in order to preheat the to-be-reduced material 1 before the to-be-reduced material 1 flows into the reducing unit 20. The temperature adjusting device may be a heater.

In addition, in the preheating unit 10, the vacuum device 70 may be installed while penetrating one surface of the preheating unit body 11 in order to maintain a vacuum state. The vacuum device may be a vacuum pump.

When the preheating of the to-be-reduced material 1 is completed, the first gate device 40 disposed between the preheating unit 10 and the reducing unit 20 is opened, and then the to-be-reduced material 1 is loaded into the reducing unit 20.

The gate device may include an inert gas inlet 90 that is formed while penetrating one surface of a gate device body. The inert gas may be argon.

In addition, the gate device may include the vacuum device 70 which is installed while penetrating one surface of the gate device body. The vacuum device 70 may be a vacuum pump.

The reducing unit 20 may include: the reducing unit body 21 which includes a third opening, and a fourth opening formed at a position opposite to the third opening; and the first blocking unit 22 and the second blocking unit 24 which are installed in the reducing unit body 21.

In addition, in the reducing unit, the temperature adjusting device 80 may be installed in the reducing unit body 21 in order to heat the to-be-reduced material 1. The temperature adjusting device 80 may be a heater.

The first blocking unit may be positioned between the first gate device 40 and the second blocking unit 24, and may have a first space 201 formed between the first gate device 40 and the first blocking unit 22, a second space 202 formed between the first blocking unit 22 and the second blocking unit 24, and a third space 203 formed between the second blocking unit 24 and the second gate device 41.

The first blocking unit and the second blocking unit may be made of graphite.

In addition, the first blocking unit and the second blocking unit may be moved upward and downward by pneumatic cylinders.

The condensing device 60 may be installed in the second space while penetrating the reducing unit body 21. The vacuum device 70 may be installed to be connected with the condensing device. The vacuum device may be a vacuum pump.

The first space and the third space may include inert gas inlets 90 that are formed while penetrating the reducing unit body. The inert gas may be argon.

The condensing devices 60 may be further installed in the first space and the third space while penetrating the reducing unit body 21. The vacuum device 70 may be installed to be connected with the condensing device.

The cooling unit may include: a cooling unit body 31 which has a fifth opening, and a sixth opening formed opposite to the fifth opening; a second door 32 which is openably and closably coupled to the sixth opening; and at least one vacuum device which is installed while penetrating one surface of the cooling unit body.

In addition, although not illustrated in the drawing, a conduit, which connects the reducing unit and the preheating unit, is installed to capture exhaust gas from the reducing unit and resupply the gas to the preheating unit, such that waste heat generated in the reducing unit may be recovered and reused.

A conveying device 100 for conveying the to-be-reduced material may be further included, and the conveying device may be a conveyor or a pusher.

Hereinafter, an operating state of the thermal reduction apparatus according to the exemplary embodiment of the present invention will be described in detail.

FIGS. 2A to 2F are configuration diagrams sequentially illustrating states in which the thermal reduction apparatus according to the exemplary embodiment is operated.

Figure 2A:
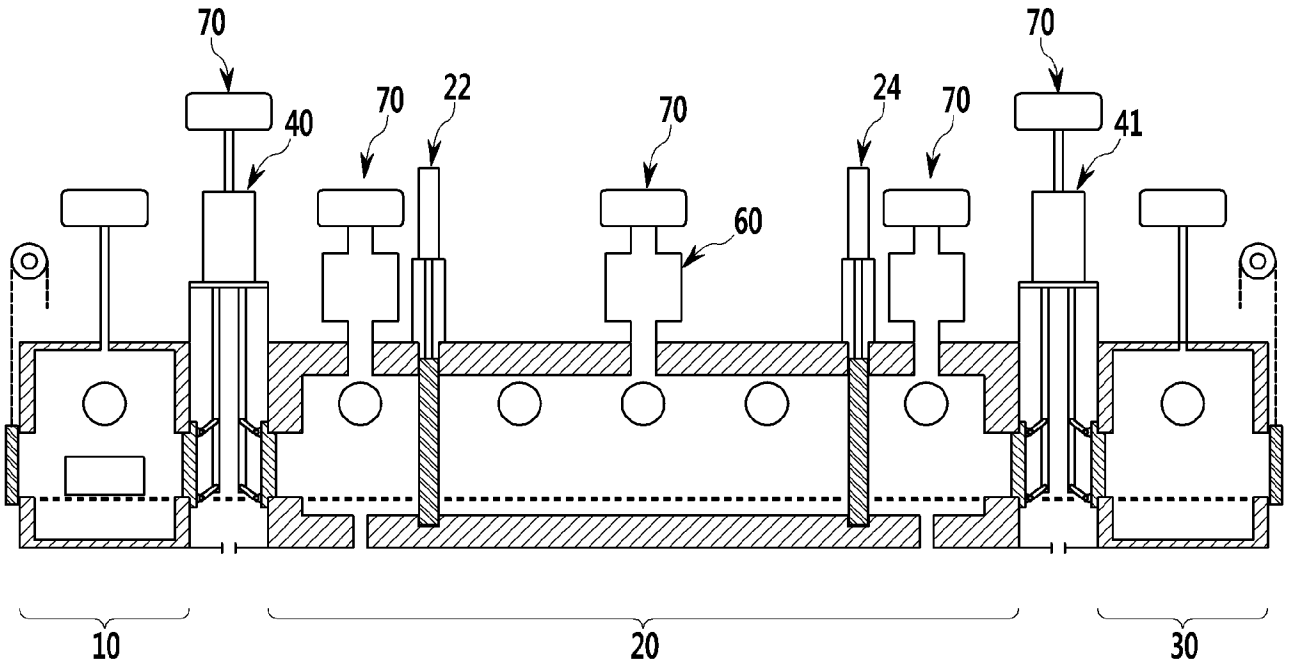
FIGS. 2A to 2F are configuration diagrams sequentially illustrating states in which the thermal reduction apparatus according to the exemplary embodiment illustrated in FIG. 1 is operated.

When the to-be-reduced material is loaded, the first door 12 is closed, and then the to-be-reduced material is preheated (FIG. 2A).

In this case, the preheating unit 10 maintains a predetermined or higher temperature by means of the temperature adjusting device 80 installed in the preheating unit body. The temperature in the preheating unit is maintained to be lower than a temperature in the reducing unit.

The temperature range may be from 700° C. to 1000° C.

In addition, the preheating unit 10 maintains a vacuum state by means of the vacuum device 70.

When the preheating of the to-be-reduced material is completed, the first gate device 40 disposed between the preheating unit and the reducing unit is opened, and the to-be-reduced material is loaded into the reducing unit 20.

Inert gas is injected into the first gate device through the inert gas inlet 90, thereby maintaining an inert gas atmosphere. A vacuum state is maintained by the vacuum device. Therefore, it is possible to prevent the preheated to-be-reduced material from coming into contact with air and reacting with it.

Figure 2B:
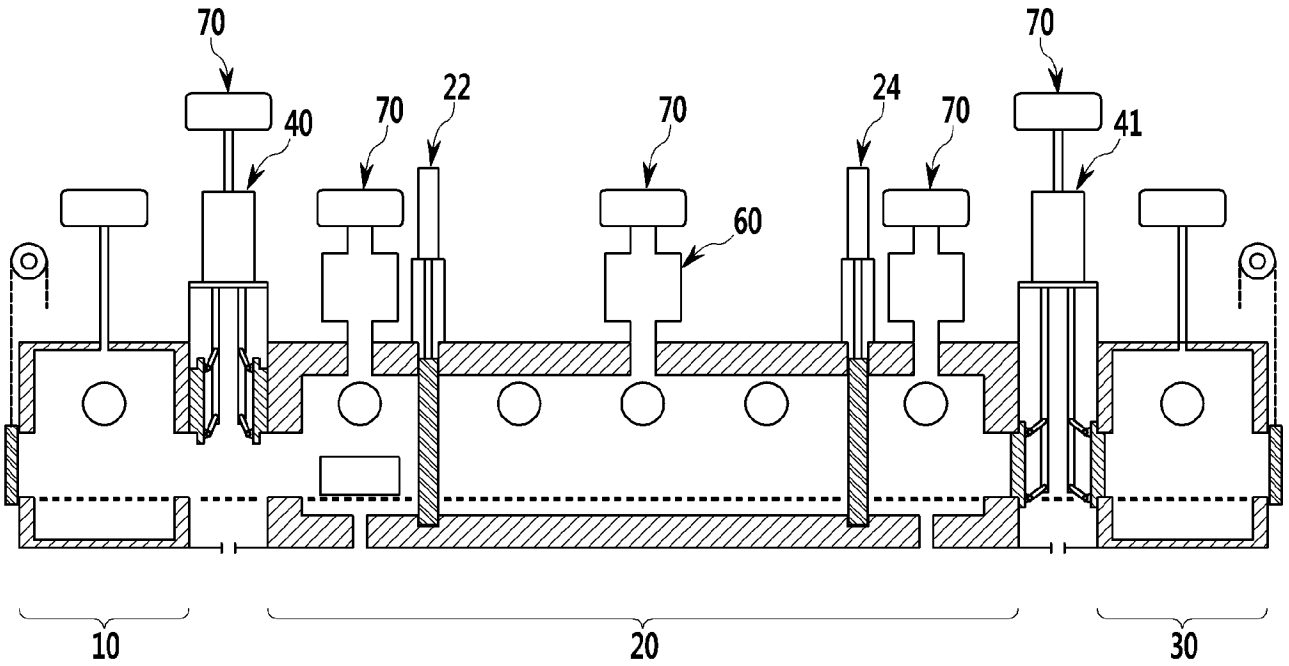

The to-be-reduced material 1 is first loaded into the first space 201 from the preheating unit. In this case, the first space is closed by the first blocking unit 22 in order to prevent the metal vapor from flowing into the first space from the second space, and to block heat transfer from the second space (FIG. 2B).

The temperature in the first space 201 is maintained to be higher than the temperature in the preheating unit 10 and lower than the temperature in the second space 202. In this case, the temperature range may be from 800° C. to 1000° C. In addition, the first space is maintained to be in a vacuum state.

When the to-be-reduced material is completely loaded into the first space, the first gate device 40 disposed between the preheating unit and the reducing unit is closed and the first blocking unit 22 is opened, such that the to-be-reduced material is loaded into the second space.

When the inert gas is injected into the first space through the inert gas inlet 90 and the vacuum device installed in the first space is operated, the metal vapor flowing out from the second space is moved to the condensing device installed in the first space. Accordingly, the metal vapor flowing out from the second space may be captured by the condensing device installed in the first space.

Figure 2C:
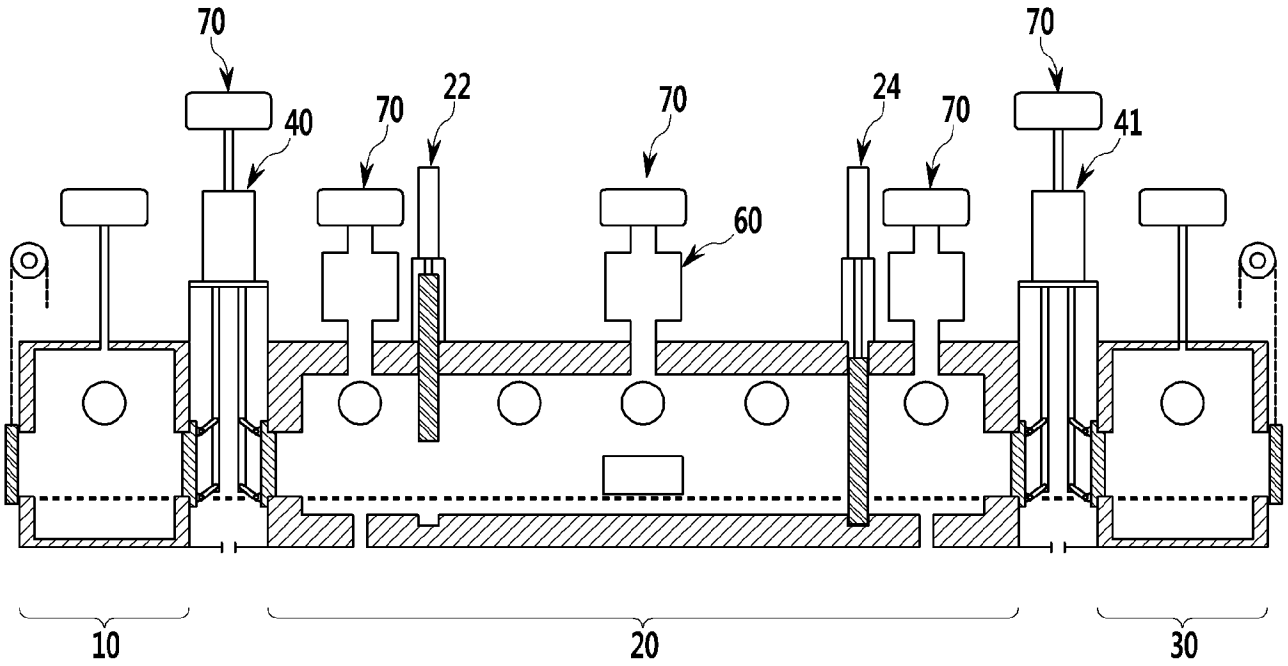

In addition, the second blocking unit is closed in order to block outflow of the metal vapor and heat transfer (FIG. 2C).

The second space is maintained in a vacuum state, and the temperature range in the second space may be from 1100° C. to 1300° C.

In the second space, the to-be-reduced material is reduced in the form of a metal vapor, and the reduced metal vapor is condensed by the condensing device 60.

Figure 2D:
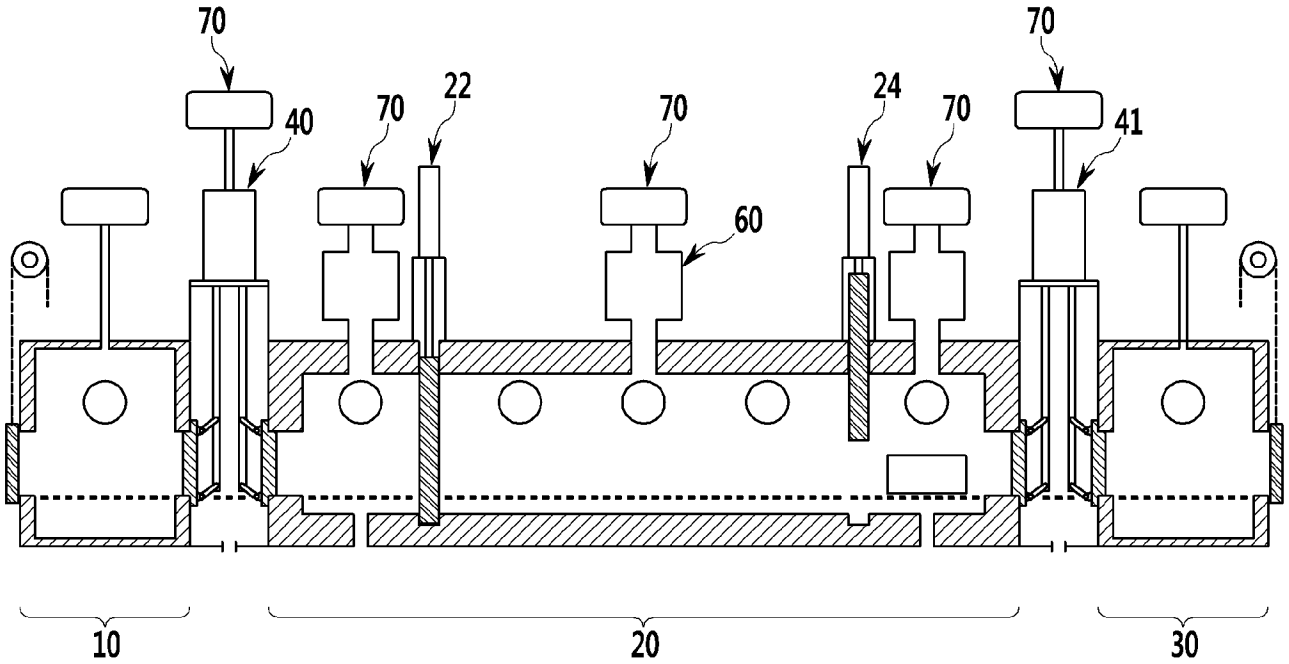

When the reduction of the to-be-reduced material is completed, the second blocking unit is opened, and the reduced material is loaded into the third space 203. In this case, the second gate device 41 installed between the reducing unit and the cooling unit is closed (FIG. 2D).

When the inert gas is injected into the third space through the inert gas inlet and the vacuum device installed in the third space is operated, the metal vapor (reduced material) flowing out from the second space is moved to the condensing device installed in the third space. Accordingly, the metal vapor flowing out from the second space may be captured by the condensing device installed in the third space.

In addition, the temperature in the third space 203 is maintained to be higher than the temperature in the cooling unit 30 and lower than the temperature in the second space 202. In this case, the temperature range may be from 800° C. to 1000° C. In addition, the third space is maintained in a vacuum state.

Figure 2E:
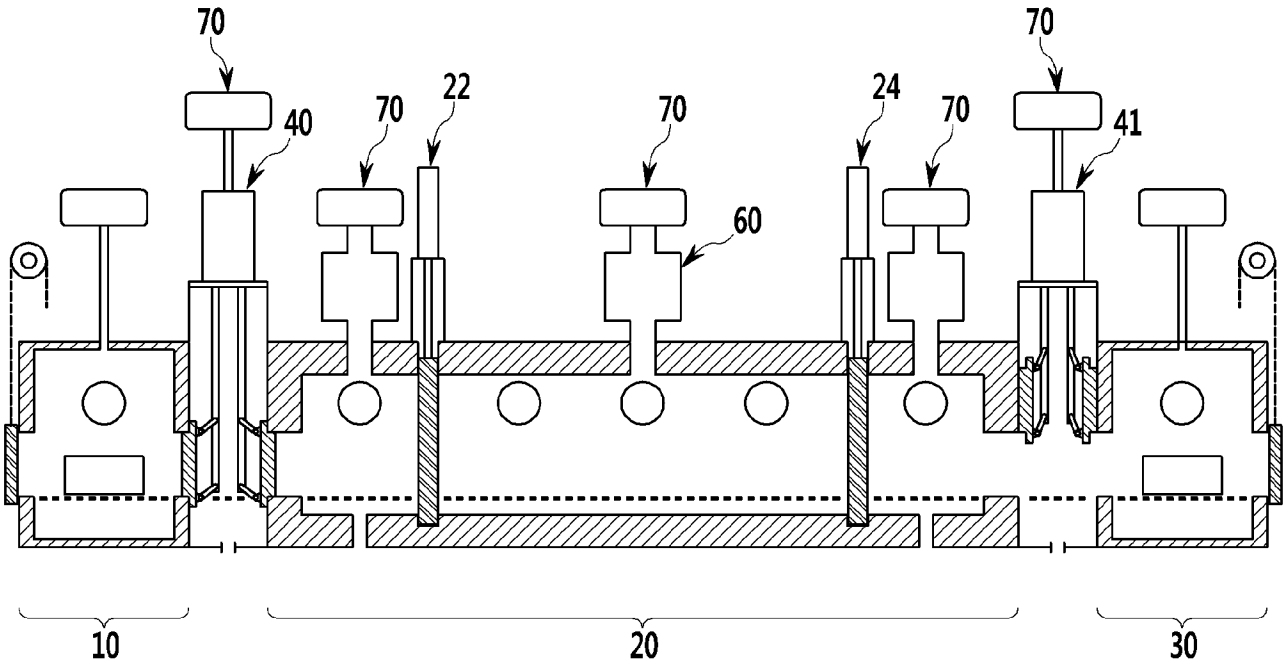

When the to-be-reduced material is completely loaded into the third space 203, the second gate device 41 installed between the reducing unit and the cooling unit is opened, and the reduced material is loaded into the cooling unit 30 placed in a vacuum state. In this case, the second door is closed (FIG. 2E).

The inert gas is injected into the second gate device 41 through the inert gas inlet 90, thereby maintaining an inert gas atmosphere.

Figure 2F:
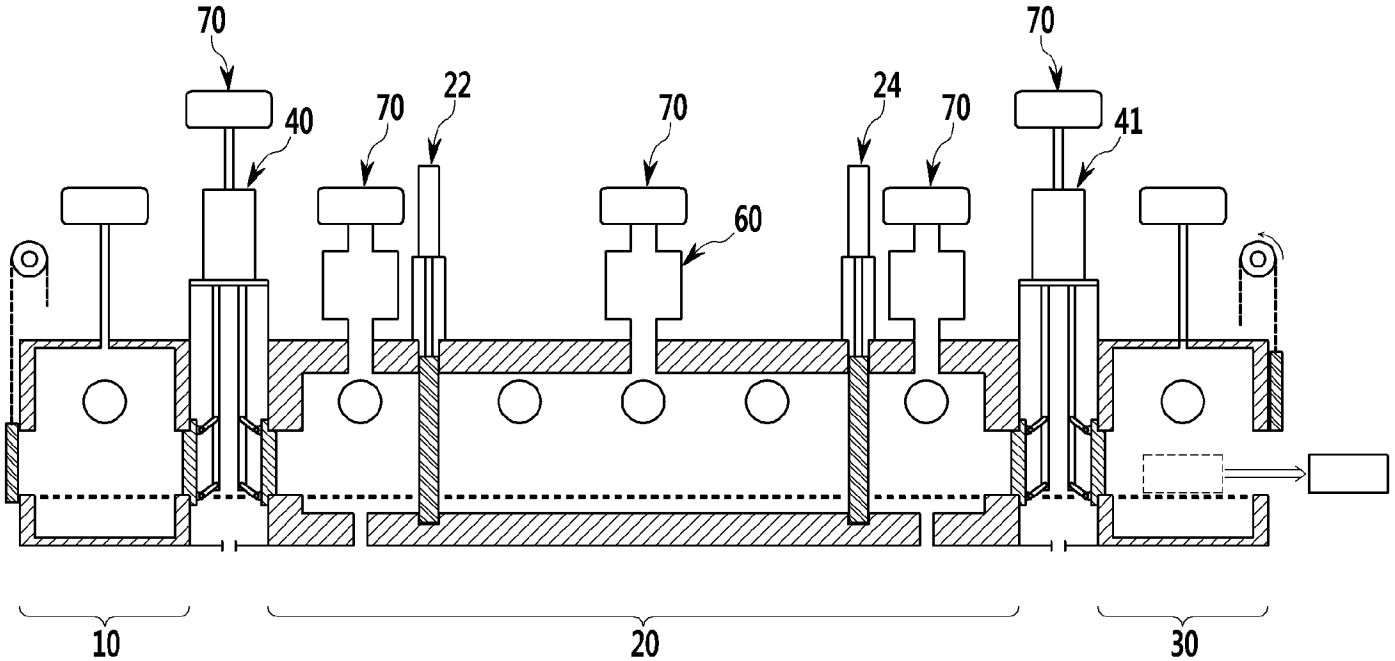

When the cooling of the to-be-reduced material is completed, the pressure in the cooling unit is converted to normal pressure, and then the second door is opened to unload the reduced material (FIG. 2F).

The cooling method may be an air cooling method.

The reduced material may be a fired body produced when the magnesium briquette is fired together with a reductant.

While the configuration in which the single to-be-reduced material is used has been described as an example in FIGS. 2A to 2F for better understanding of the present invention, it is possible to thermally reduce the to-be-reduced material while at least one to-be-reduced material is continuously loaded and unloaded as illustrated in FIG. 1.

Second Exemplary Embodiment

Figure 3:
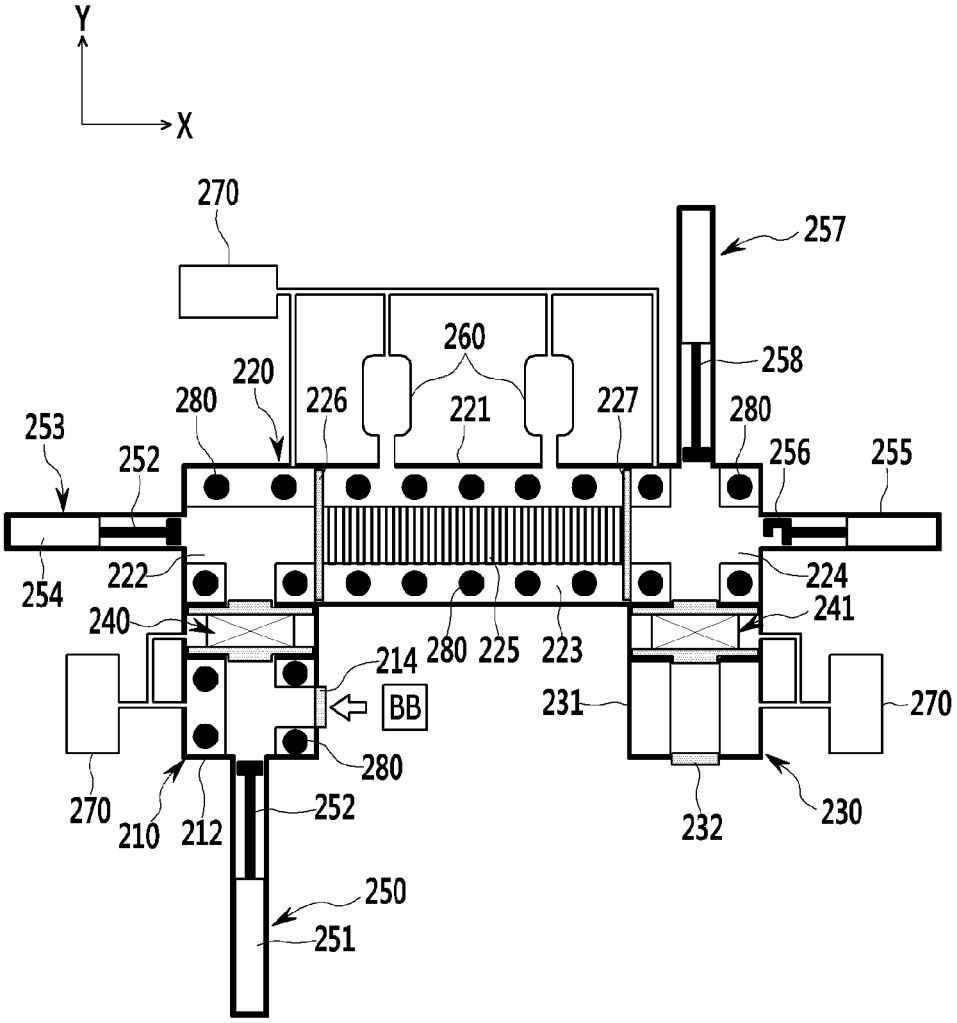
FIG. 3 is a configuration diagram of a thermal reduction apparatus according to another exemplary embodiment.

FIG. 3 illustrates a configuration of a thermal reduction apparatus according to the present exemplary embodiment.

Referring to FIG. 3, the thermal reduction apparatus according to the present exemplary embodiment includes: a preheating unit 210 which preheats a to-be-reduced material; a reducing unit 220 which is connected to the preheating unit and in which a thermal reduction reaction of the to-be-reduced material occurs; a cooling unit 230 which is connected to the reducing unit and from which the to-be-reduced material loaded into the cooling unit 230 is unloaded; a first gate valve 240 which is installed between the preheating unit and the reducing unit; a second gate valve 241 which is installed between the reducing unit and the cooling unit; and a condensing device 260 which is connected to the reducing unit and condenses a metal vapor.

For example, the to-be-reduced material may be accommodated in a briquette box BB having a predetermined size and an accommodating space, and may then be moved as a unit of the briquette box.

The preheating unit 210 includes: a preheating unit body 212 which has a first opening through which the to-be-reduced material is loaded, and a second opening through which the to-be-reduced material, which is primarily preheated, is unloaded; a first door 214 which is openably and closably coupled to the first opening; and a vacuum device 270 which is installed while penetrating one surface of the preheating unit body 212. The second opening may be opened and closed by the first gate valve 240.

The preheating unit 210 includes a temperature adjusting device 280 which is installed in the preheating unit body 212 and preheats the to-be-reduced material. In the preheating unit, the temperature adjusting device for preheating the to-be-reduced material may be, for example, a heater.

In the preheating unit 210, the vacuum device 270 may be installed while penetrating one surface of the preheating unit body in order to maintain a vacuum state. For example, the vacuum device may be a vacuum pump.

The first gate valve 240 may be connected with the vacuum device 270. The second gate valve 241 has the same structure as the first gate valve 240.

When the preheating of the to-be-reduced material is completed, the first gate valve 240 disposed between the preheating unit and the reducing unit 220 is opened, and the to-be-reduced material is loaded into the reducing unit 220.

The reducing unit 220 may include: a reducing unit body 221 which defines an internal space and in which metal vapor is produced through a thermal reduction process; a first blocking membrane 226 which is installed in the reducing unit body; and a second blocking membrane 227 which is installed to be spaced apart from the first blocking membrane 226.

In the reducing unit, the temperature adjusting device 280 may be installed in the reducing unit body in order to heat the to-be-reduced material. The temperature adjusting device 280 may be a heater.

The reducing unit body 221 is divided into three regions by the first blocking membrane 226 and the second blocking membrane 227. The reducing unit body 221 is divided into the three regions sequentially disposed in a movement direction of the to-be-reduced material, and the three regions include a first space 222 disposed before the first blocking membrane, a second space 223 disposed between the first blocking membrane and the second blocking membrane, and a third space 224 disposed after the second blocking membrane.

The temperature in the second space 223 may be set to be higher than the temperature in the first space 222 and the third space 224. The first blocking membrane 226 and the second blocking membrane 227 may be made of graphite. The first blocking membrane 226 and the second blocking membrane 227 may be moved upward and downward by pneumatic cylinders.

The cooling unit 230 may include: a cooling unit body 231 into which the to-be-reduced material passing through the reducing unit flows; a second door 232 which is openably and closably coupled to the cooling unit body 231; and at least one vacuum device 270 which is installed while penetrating one surface of the cooling unit body.

The condensing device 260 may be installed in the second space 223 while penetrating the reducing unit body 221. The vacuum device 270 may be installed to be connected with the condensing device. The vacuum device may be a vacuum pump. The condensing devices 260 may be further installed in the first space 222 and the third space 224 while penetrating the reducing unit body 221. The vacuum device 270 may be installed to be connected with the condensing device.

In the present exemplary embodiment, the preheating unit 210 is disposed at a lateral side of the reducing unit body 221 with respect to the movement direction of the to-be-reduced material, and is connected to a lateral side of the first space 222 of the reducing unit body.

In the following description, the movement direction of the to-be-reduced material means an x-axis direction in FIG. 3, and the lateral side means a side directed along a y-axis in FIG. 3 or a direction thereof.

The first gate valve 240 is installed between the lateral side of the first space 222 and the preheating unit. When the first gate valve 240 is opened, the preheating unit 210 and the first space 222 of the reducing unit body are in communication with each other.

A loader 250 moves the to-be-reduced material to the first space 222 through the lateral side of the reducing unit body. To this end, the loader 250 includes a first drive cylinder 251 which is installed to the preheating unit and pushes the to-be-reduced material toward the first space 222 while being extended toward the first space 222 of the reducing unit body.

As illustrated in FIG. 3, the first drive cylinder 251 is installed at a lateral side of the preheating unit body 212 and extended toward the first space 222. A pushing plate 252 formed in the form of a plate may be installed at a tip of a piston rod of the first drive cylinder 251 so as to easily push the to-be-reduced material.

A rail member (not illustrated), which is extended toward the first space 222, may be further installed at the bottom of the preheating unit 210 so that the to-be-reduced material may be smoothly moved when the first drive cylinder 251 pushes and moves the to-be-reduced material.

The thermal reduction apparatus further includes a moving unit 253 which is installed to the reducing unit 220 and continuously moves the to-be-reduced material, which has been moved to the reducing unit, along the reducing unit.

The moving unit 253 includes a second drive cylinder 254 which is installed at a tip of the first space 222 of the reducing unit body and pushes the to-be-reduced material moved to the first space 222 toward the second space 223 of the reducing unit body while being extended toward the second space 223.

The second drive cylinder 254 is installed at the tip of the first space 222 so as to be extended and retracted in the movement direction of the to-be-reduced material. The second drive cylinder 254 and the preheating unit 210 are disposed at a right angle to each other in the first space 222, such that the second drive cylinder 254 and the preheating unit 210 do not interfere with each other when the to-be-reduced material is moved. The pushing plate 252 formed in the form of a plate may be installed at a tip of a piston rod of the second drive cylinder 254 so as to easily push the to-be-reduced material.

Accordingly, when the second drive cylinder 254 is extended, the to-be-reduced material placed in the first space 222 is moved to the second space 223.

In the present exemplary embodiment, the to-be-reduced materials in the second space 223 of the reducing unit body 221 are moved by being pushed by the to-be-reduced materials that are continuously moved from the first space 222. Rollers 225, on which the to-be-reduced materials are placed and moved, are freely rotatably installed in the second space 223 so as to be disposed at intervals, so that the to-be-reduced materials may be more smoothly pushed and moved in the second space 223.

The moving unit 253 further includes a third drive cylinder 255 which is installed at a tip of the third space 224 of the reducing unit body and draws the to-be-reduced material in the second space 223 toward the third space 224 while being extended toward the second space 223. The third drive cylinder 255 is installed at an outer tip of the third space 224 and extended toward the second space 223. The third drive cylinder 255 serves to draw the to-be-reduced material positioned in the second space 223 toward the third space 224, and thus a clamp 256, which selectively fixes the to-be-reduced material, may be installed at a tip of a piston rod. The clamp may have any structure as long as it may be coupled to and decoupled from the briquette box that accommodates the to-be-reduced material.

Therefore, when the third drive cylinder 255 is extended, the clamp 256 installed at the tip of the piston rod is moved to the second space 223 and clamps and fixes the to-be-reduced material, and when the third drive cylinder 255 is retracted in this state, the to-be-reduced material clamped by the clamp 256 is drawn toward the third space 224.

The to-be-reduced material moved to the third space 224 is moved to the cooling unit 230 connected to the third space 224.

The cooling unit 230 is disposed at a lateral side of the reducing unit body 221 with respect to the movement direction of the to-be-reduced material, and is connected to a lateral side of the third space 224 of the reducing unit body.

The second gate valve 241 is installed between the lateral side of the third space 224 and the cooling unit. When the second gate valve 241 is opened, the cooling unit and the third space 224 of the reducing unit body are in communication with each other.

In the present exemplary embodiment, the thermal reduction apparatus further includes a drawer 257 which is installed at a lateral side of the third space 224 of the reducing unit body and moves the to-be-reduced material moved to the third space 224 toward the cooling unit.

The drawer 257 includes a fourth drive cylinder 258 which is installed at the lateral side of the third space 224 and pushes the to-be-reduced material in the third space 224 toward the cooling unit while being extended toward the cooling unit 230.

As illustrated in FIG. 3, the fourth drive cylinder 258 is installed at the lateral side of the third space 224 of the reducing unit body opposite to the cooling unit 230, and is extended toward the cooling unit. The pushing plate 252 formed in the form of a plate may be installed at a tip of a piston rod of the fourth drive cylinder 258 so as to easily push the to-be-reduced material. The fourth drive cylinder 258 and the third drive cylinder 255 are disposed at a right angle to each other in the third space 224, such that the fourth drive cylinder 258 and the third drive cylinder 255 do not interfere with each other when the to-be-reduced material is moved.

As described above, the to-be-reduced materials are continuously and sequentially moved from the preheating unit to the cooling unit by the extension and retraction of the respective drive cylinders. Accordingly, the present apparatus may continuously and thermally reduce the plurality of to-be-reduced materials and recover metal.

Hereinafter, a thermal reduction process according to the exemplary embodiment of the present invention will be described below.

FIGS. 4A to 4K sequentially illustrate processes of thermally reducing the to-be-reduced material using the thermal reduction apparatus according to the present exemplary embodiment. In the following description, an example in which the to-be-reduced material is a fired body produced when a magnesium briquette is fired together with a reductant will be described. The present exemplary embodiment is not limited thereto, but may be applied to processes of reducing various types of metal. The to-be-reduced material is accommodated in the briquette box BB and then moved as a unit of the briquette box.

In the present exemplary embodiment, briquette boxes BB accommodating the to-be-reduced material are continuously loaded and preheated in the preheating unit 210, moved to the first space 222 of the reducing unit 220, continuously reduced under a vacuum environment at a high temperature by an internal heating method while passing through the second space 223, moved to the cooling unit 230 while passing through the third space 224, cooled in the cooling unit 230, and then continuously unloaded. In this process, the respective drive cylinders are extended and retracted to continuously move the briquette box along a line.

Figure 4A:
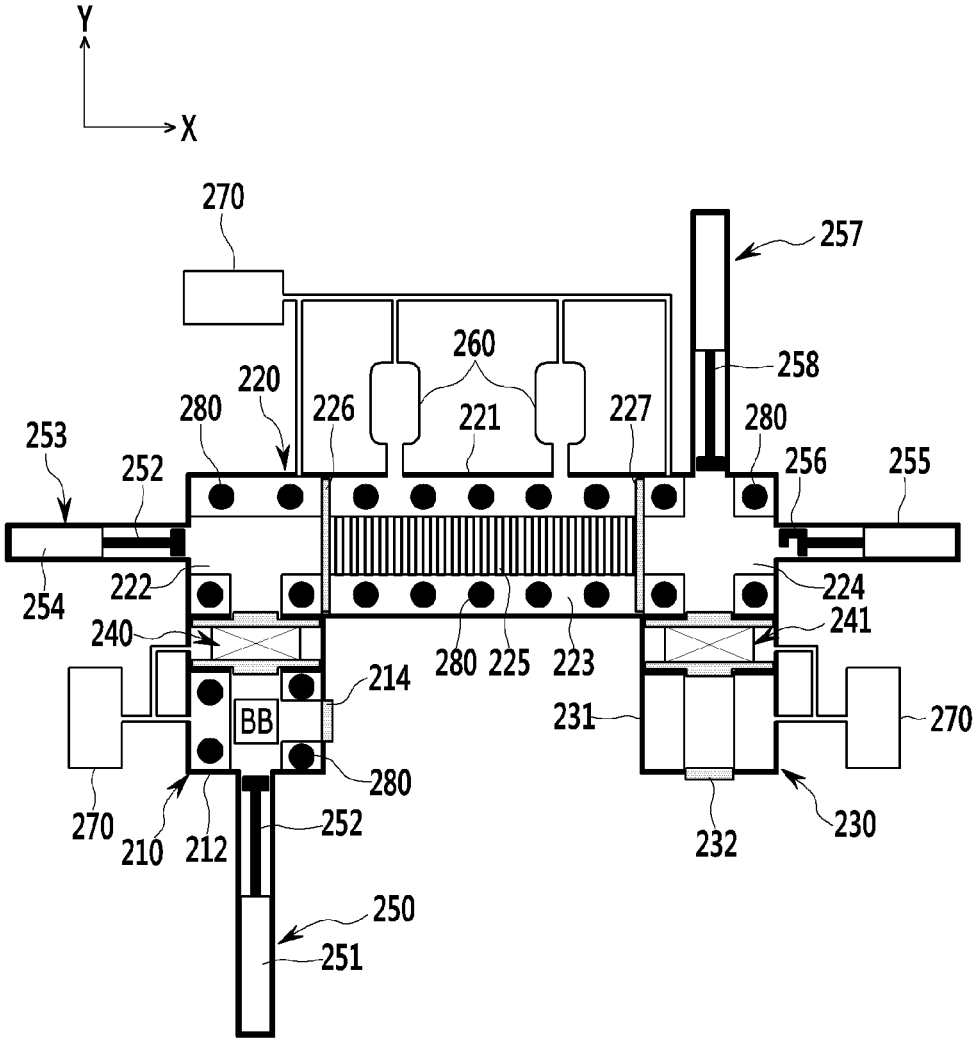
FIGS. 4A to 4K are configuration diagrams sequentially illustrating states in which the thermal reduction apparatus according to the exemplary embodiment illustrated in FIG. 3 is operated.

As illustrated in FIG. 4A, first, the preheating unit 210 is maintained at normal pressure in an inert gas atmosphere, and then the briquette box BB accommodating the to-be-reduced material is loaded through the first door 214. When the first door is closed after the briquette box BB is loaded, vacuum pressure is formed in the preheating unit 210 by the vacuum device, and the to-be-reduced material is preheated for a predetermined period of time. The preheating unit 210 is maintained at a temperature of 700° C. to 800° C., and preheats the to-be-reduced material. In this case, the first gate valve 240 is closed.

Figure 4B:
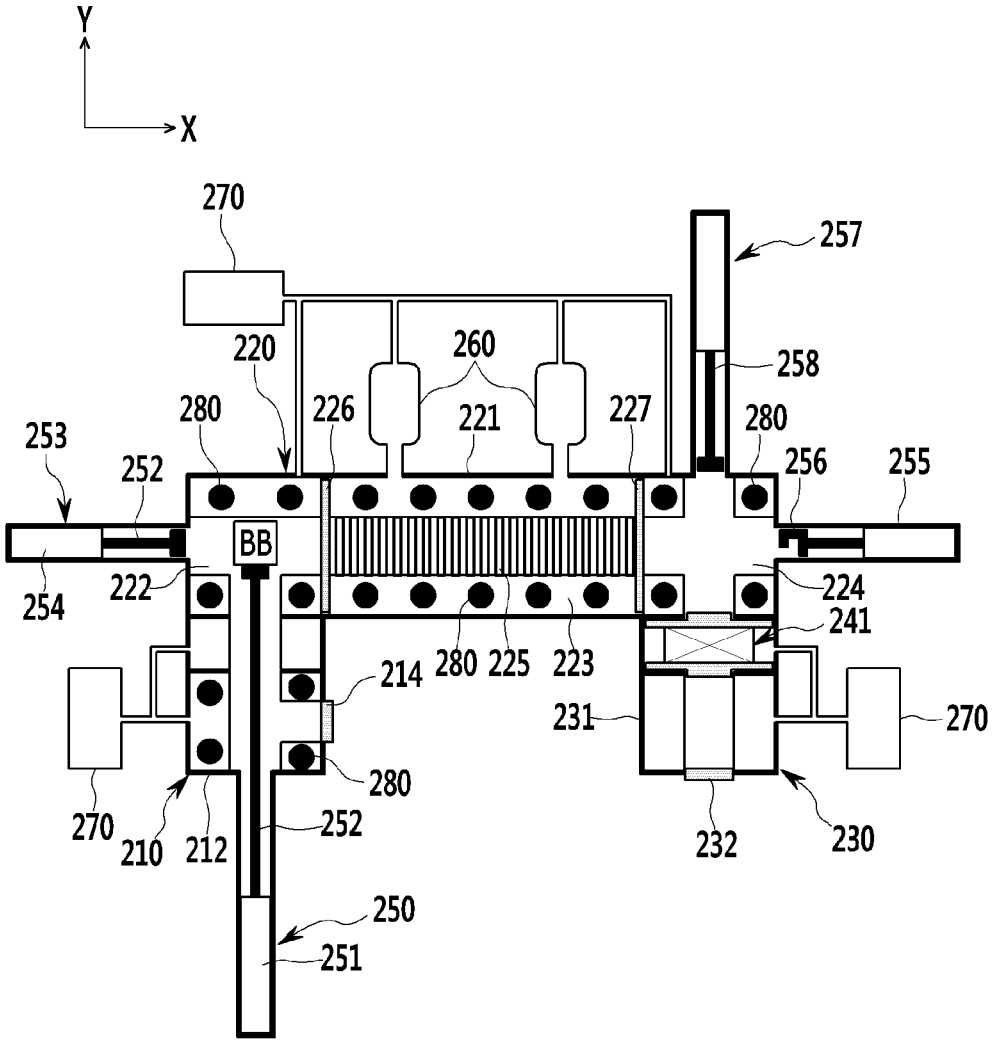

As illustrated in FIG. 4B, when the preheating of the to-be-reduced material is completed, the first gate valve 240 installed between the preheating unit 210 and the first space 222 of the reducing unit is opened, and the briquette box BB is moved to the first space 222 of the reducing unit. That is, when the first drive cylinder 251 installed to the preheating unit 210 is extended, the pushing plate 252 installed at the tip of the piston rod of the first drive cylinder 251 pushes the briquette box BB placed in the preheating unit 210 toward the first space 222. When the first drive cylinder 251 is completely extended, the briquette box BB is completely pushed to the outside of the preheating unit 210 and moved into the first space 222.

Figure 4C:
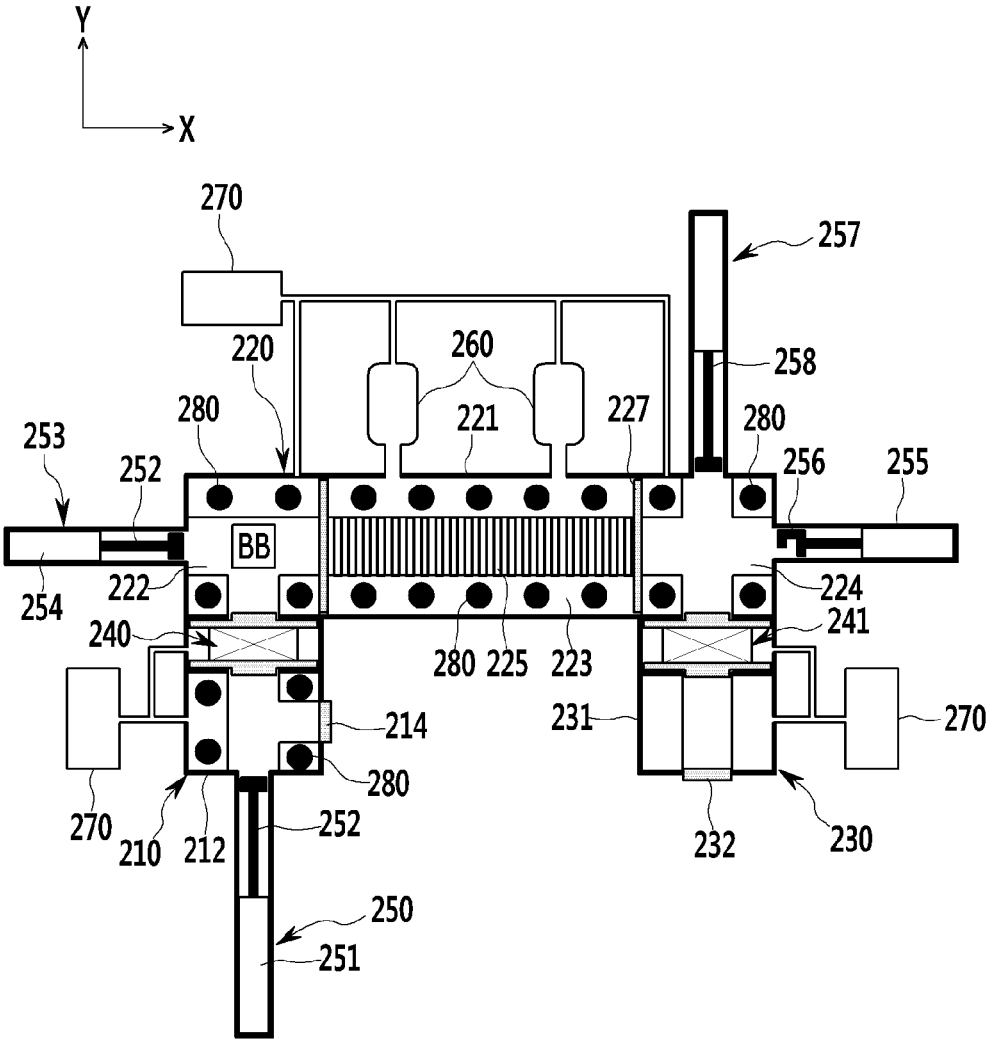

When the briquette box BB is completely moved into the first space 222, the first drive cylinder 251 is retracted back to an original position, and the first gate valve 240 is closed to block a portion between the first space 222 and the preheating unit 210, as illustrated in FIG. 4C.

Figure 4D:
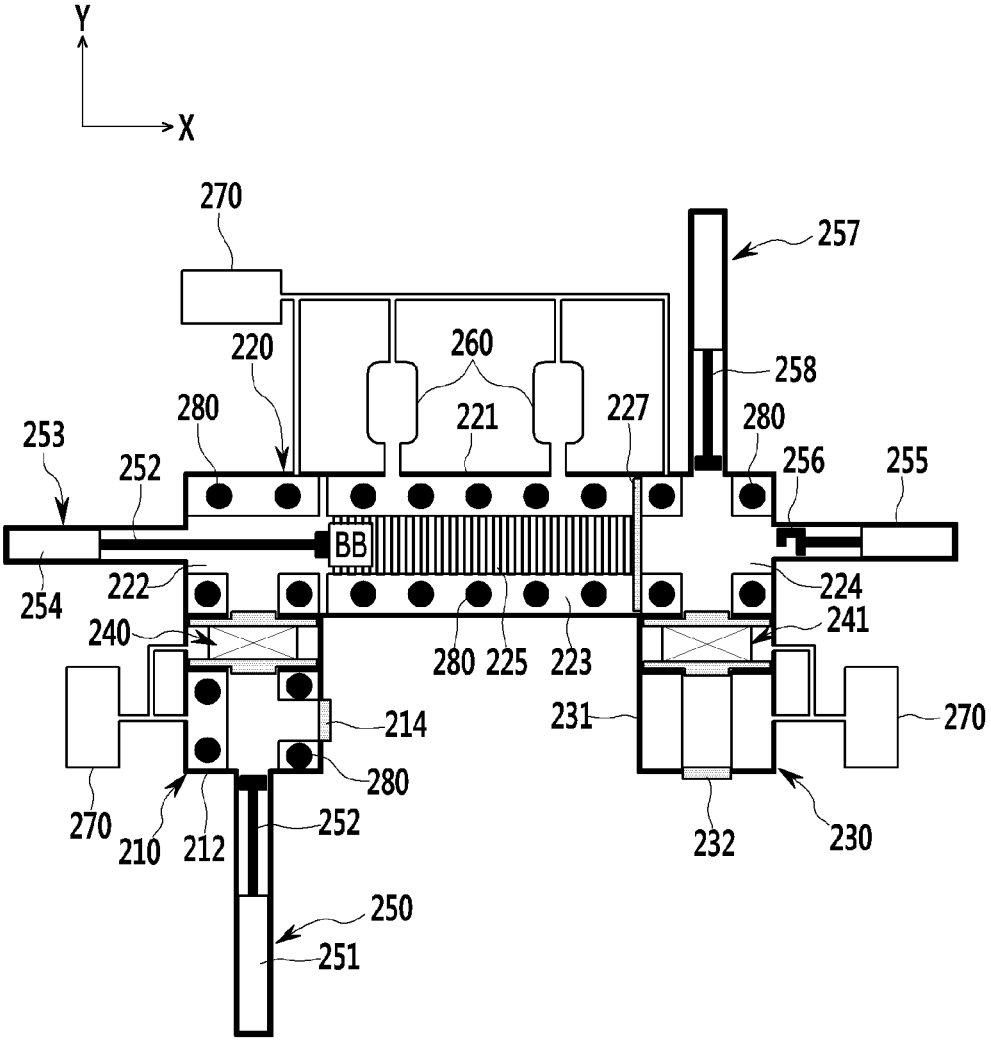
Figure 4E:
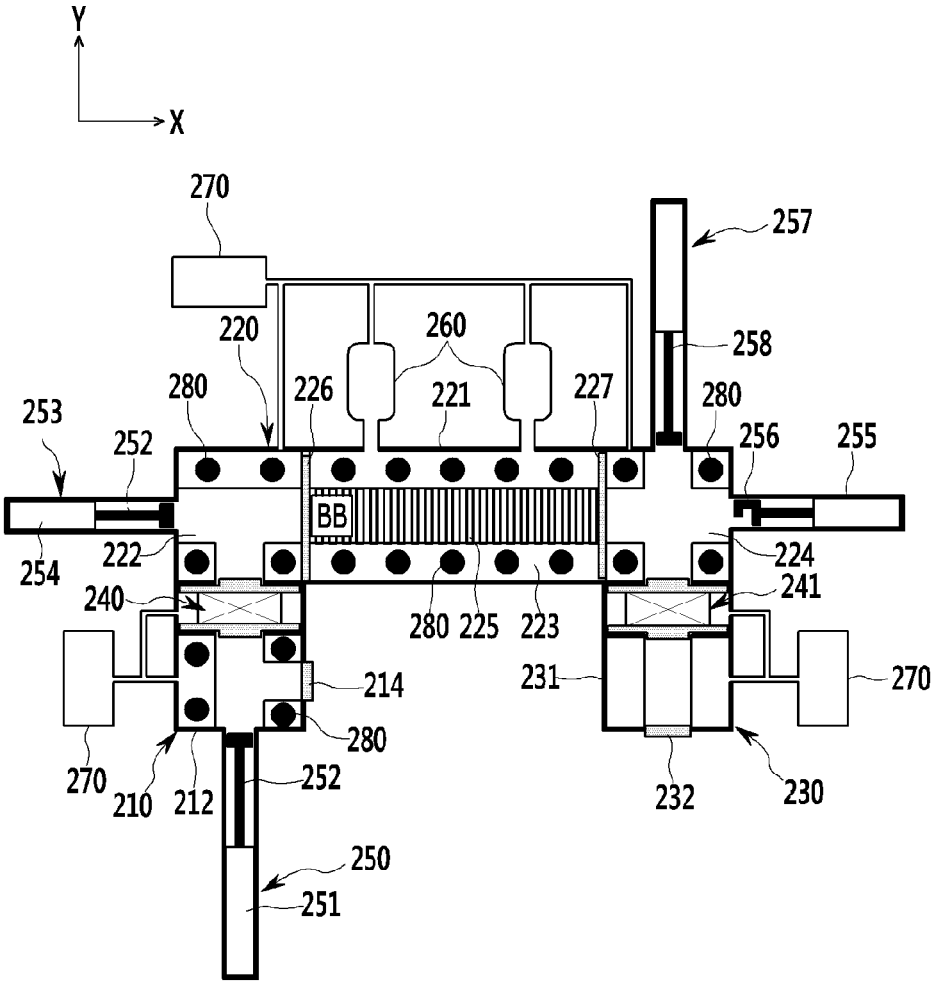

As illustrated in FIG. 4D, when the first gate valve 240 is closed, the first blocking membrane 226 of the reducing unit is opened, and the second drive cylinder 254 is extended to move the briquette box BB placed in the first space 222 toward the second space 223. When the briquette box BB is completely moved into the second space 223, the second drive cylinder 254 is retracted back to an original position, and the first blocking membrane 226 is closed, as illustrated in FIG. 4E.

Figure 4F:
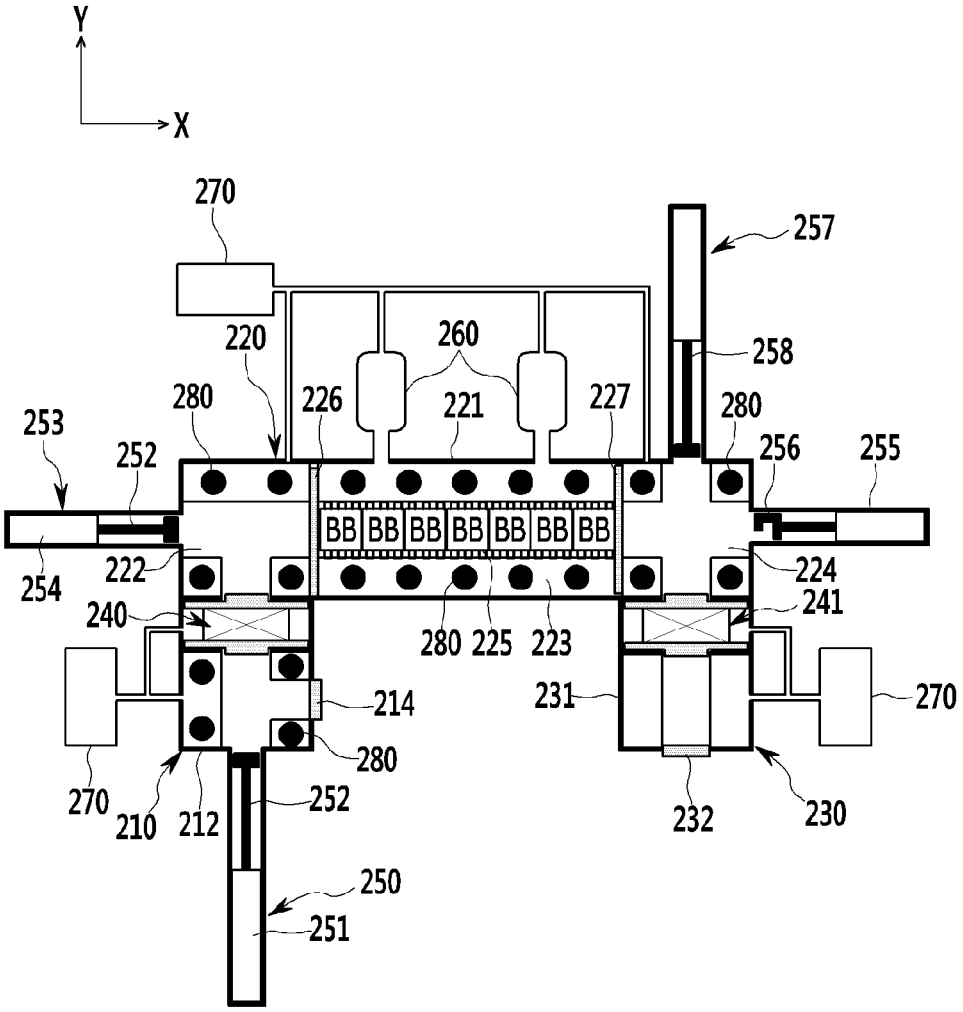

The above processes are repeated, and as a result, the briquette boxes BB may be continuously loaded into the second space 223 of the reducing unit. As illustrated in FIG. 4F, when the briquette boxes BB are continuously moved to the second space 223 of the reducing unit, the briquette box BB, which has been previously loaded into the second space 223, is moved forward while being pushed by the briquette box BB that is being newly loaded. The briquette box BB is moved up to the second blocking membrane 227 by being continuously pushed, and the second space 223 is filled with the briquette boxes BB. Since the rollers 225 which are freely rotated are installed at the bottom of the second space 223, the briquette boxes BB may be smoothly moved while sliding on the rollers.

The to-be-reduced material accommodated in the briquette box BB in the second space 223 of the reducing unit is reduced in the form of metal vapor at a high temperature under vacuum, and the reduced metal vapor is condensed by the condensing device 260.

Figure 4G:
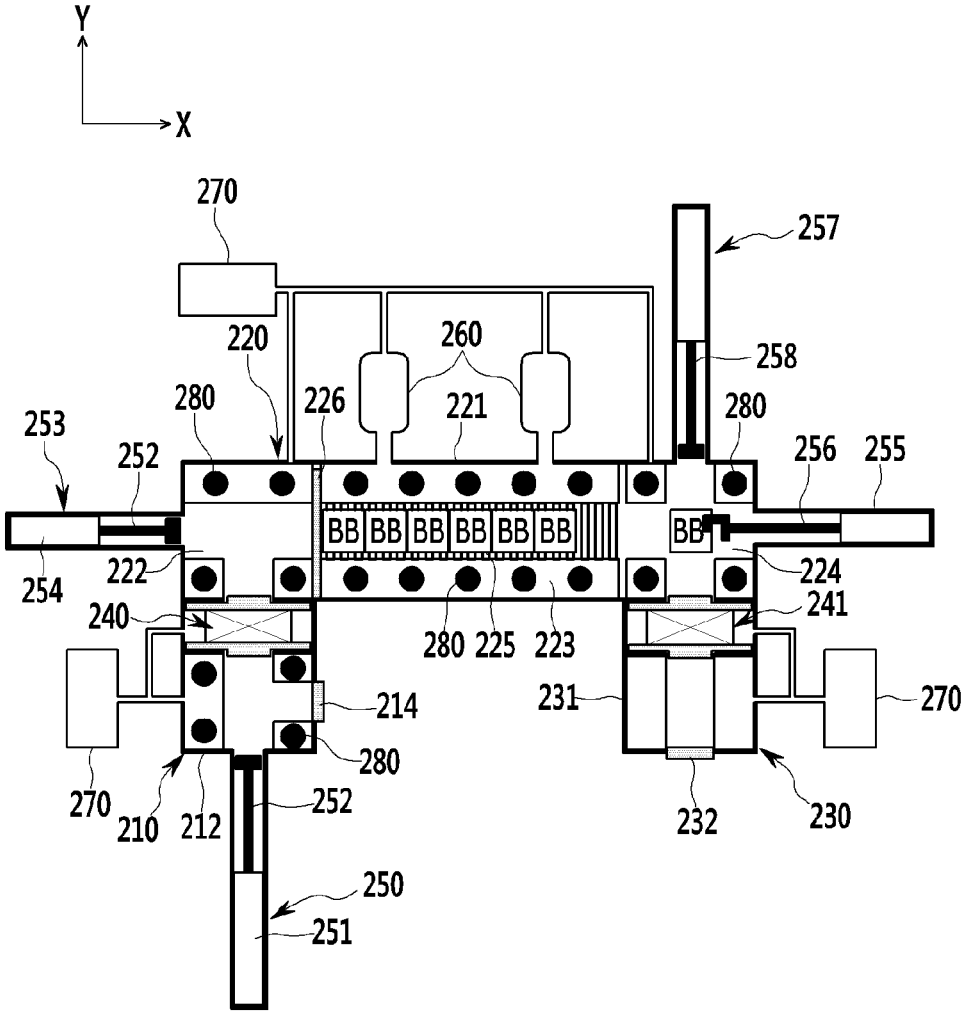

As illustrated in FIG. 4G, when the second space 223 of the reducing unit is filled with the briquette boxes BB continuously being loaded into the second space 223, the second blocking membrane 227 is opened, and the briquette box BB is moved to the third space 224 by using the third drive cylinder 255. When the third drive cylinder 255 is extended, the clamp 256 installed at the tip of the piston rod of the third drive cylinder 255 is moved toward the second space 223 and clamped to the briquette box BB placed in the second space 223. When the third drive cylinder 255 is retracted in this state, the briquette box BB coupled to the clamp is drawn toward the third space 224.

Figure 4H:
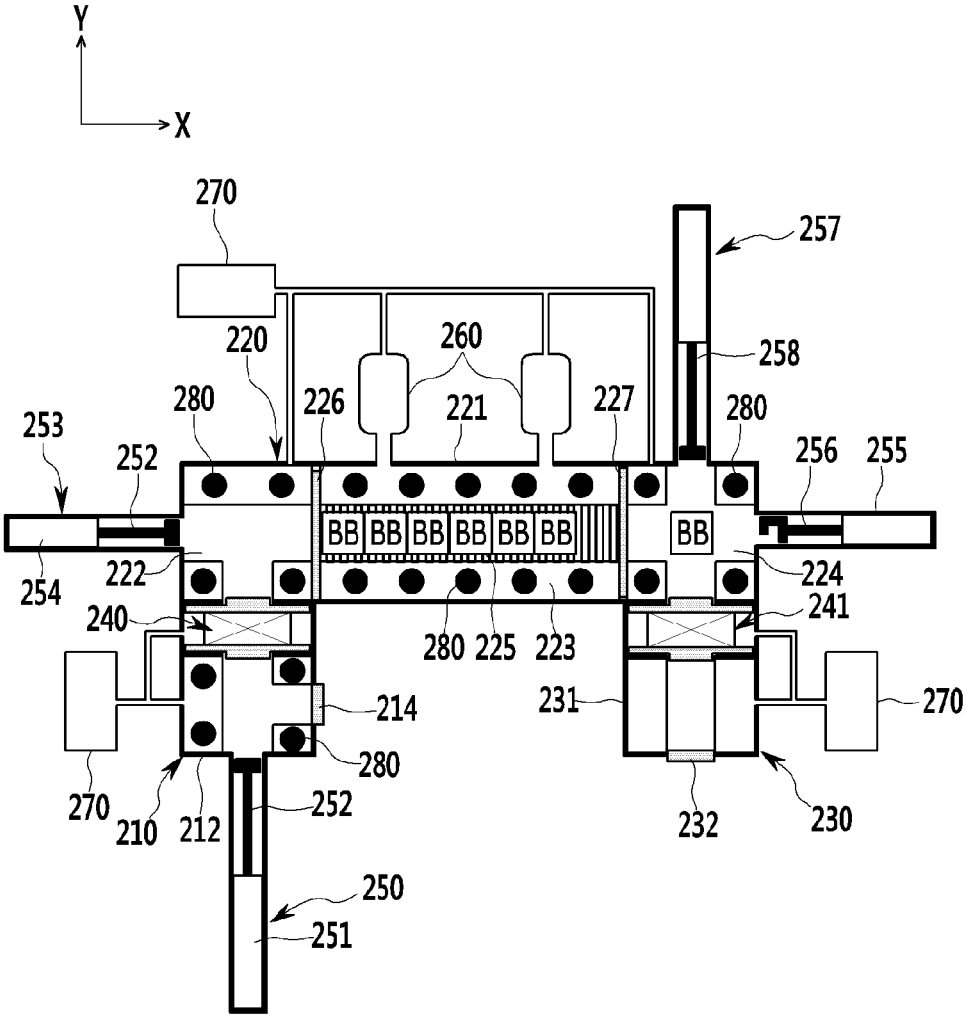

When the briquette box BB is completely moved to the third space 224, the clamp 256 is released, and the second blocking membrane 227 is closed as illustrated in FIG. 4H.

Figure 4I:
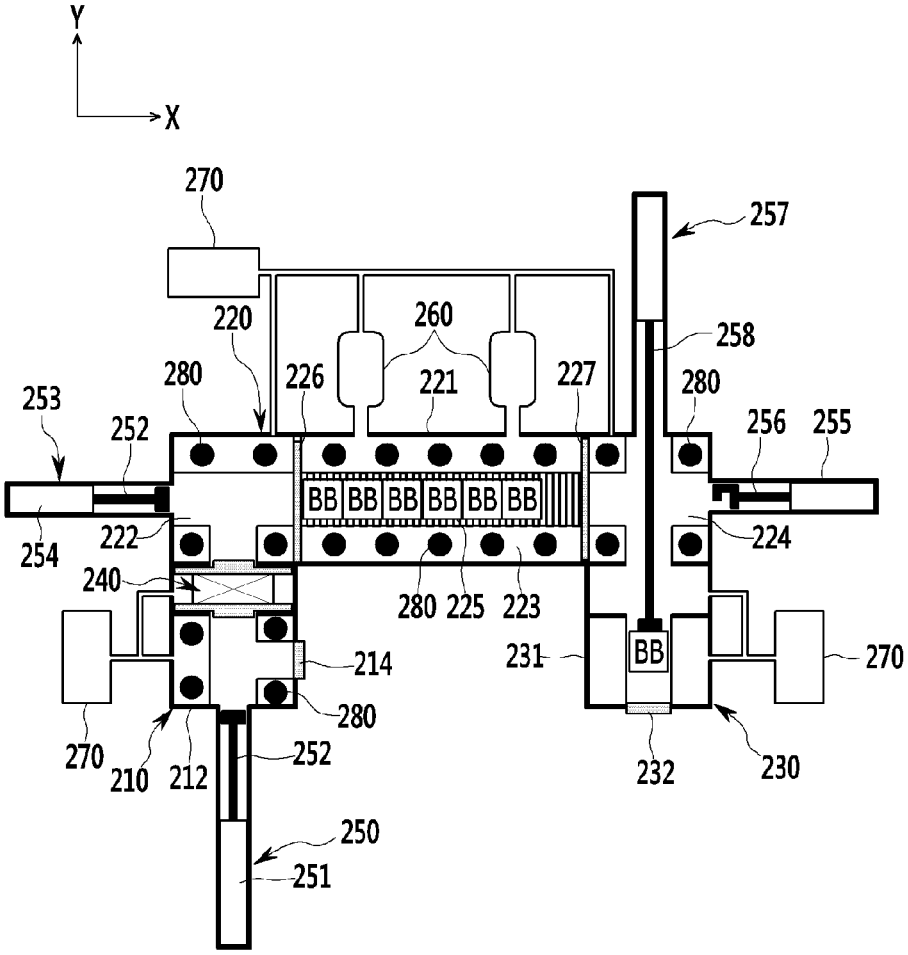

As illustrated in FIG. 4I, when the second blocking membrane 227 is closed, the second gate valve 241 is opened, and the fourth drive cylinder 258 is extended to move the briquette box BB placed in the third space 224 to the cooling unit. When the fourth drive cylinder 258 is extended, the pushing plate installed at the tip of the piston rod pushes the briquette box BB toward the cooling unit. When the fourth drive cylinder 258 is completely extended, the briquette box BB is completely pushed to the outside of the third space 224 and moved into the cooling unit.

Figure 4J:
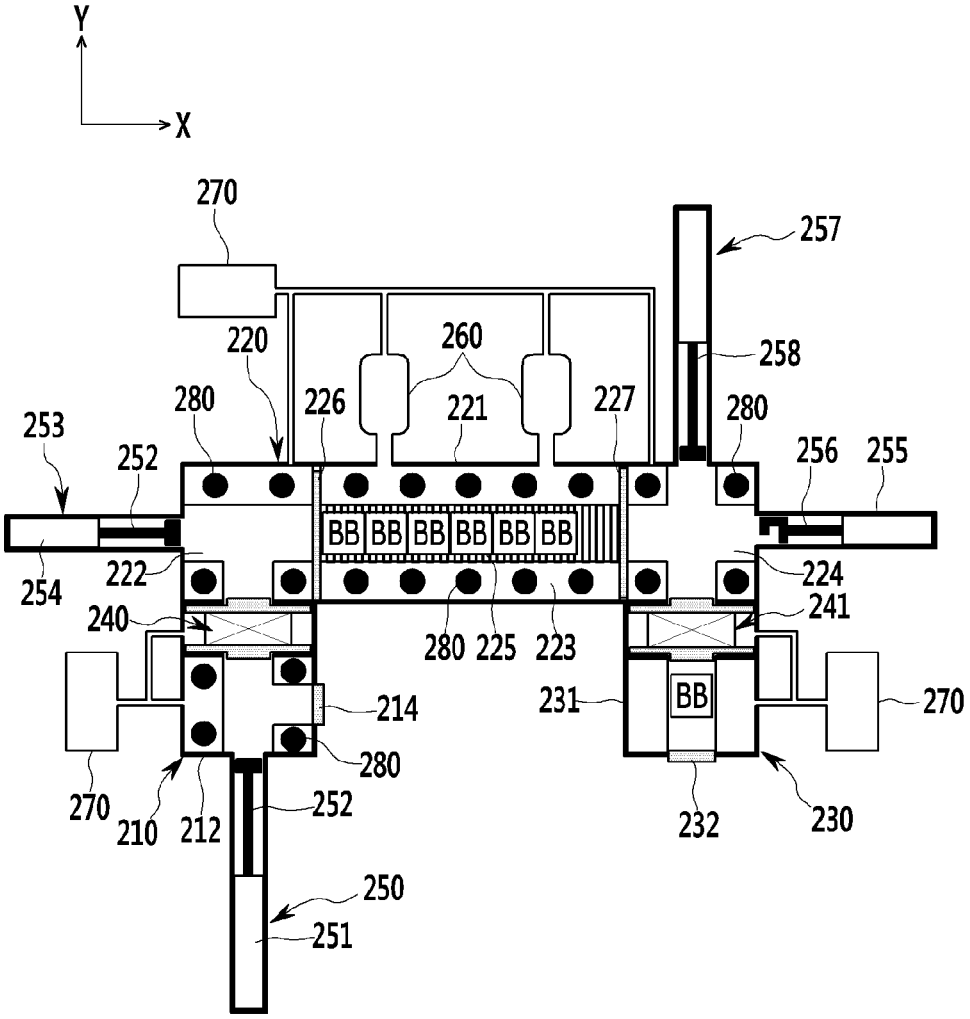

When the briquette box BB is completely moved to the cooling unit 230, the fourth drive cylinder 258 is retracted back to an original position, and the second gate valve 241 is closed to block a portion between the third space 224 and the cooling unit, as illustrated in FIG. 4J.

Figure 4K:
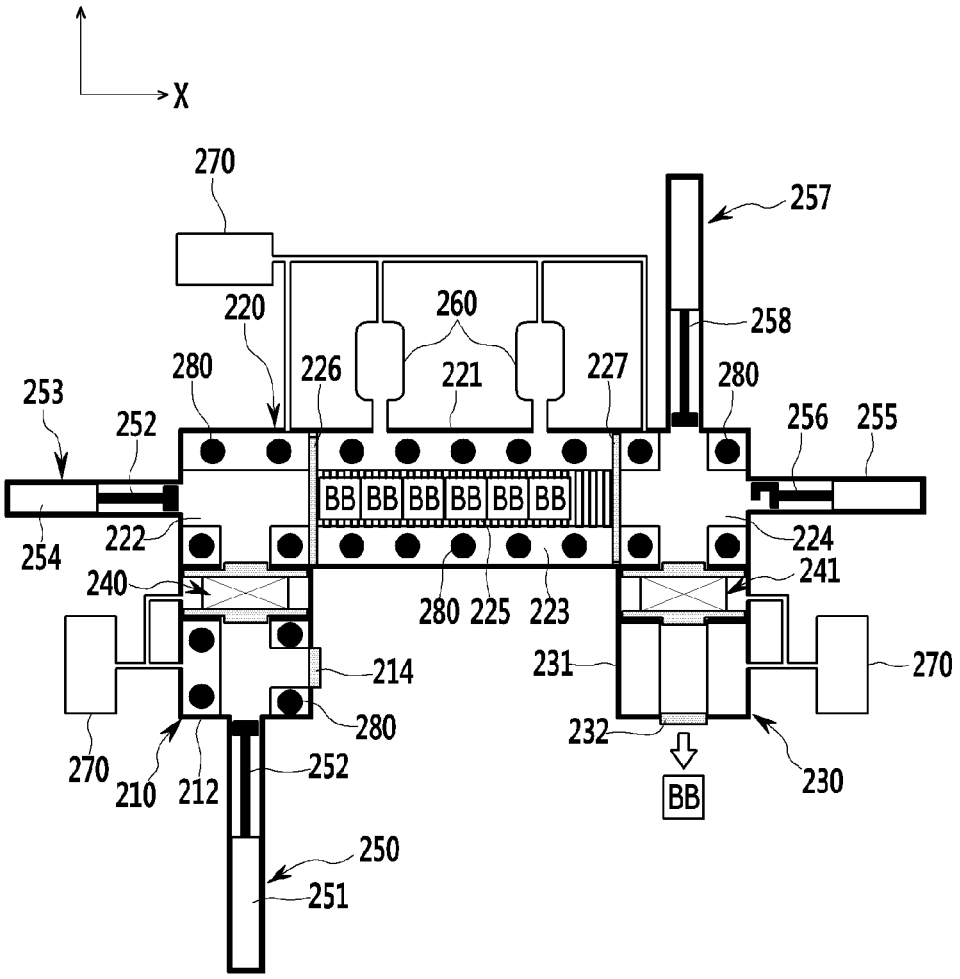

As illustrated in FIG. 4K, when the cooling of the briquette box BB is completed in the cooling unit, the inert gas is injected into the cooling unit to raise pressure to normal pressure, and then the briquette box BB is unloaded to the outside through the second door.

Through the above processes, the to-be-reduced materials may be continuously and thermally reduced while being continuously loaded and unloaded.

[Gate Device]

Hereinafter, a configuration of the gate device according to the present exemplary embodiment will be described with reference to the gate device provided in the thermal reduction apparatus according to the exemplary embodiment illustrated in FIG. 1 as an example. In the following description, constituent elements which are identical to the constituent elements that have already been described are designated by the same reference numerals, and a detailed description thereof will be omitted. The gate device is not limited to be applied to the thermal reduction apparatus illustrated in FIG. 1, and the gate device may also be equally applied to the thermal reduction apparatus having the structure illustrated in FIG. 3.

Figure 5:
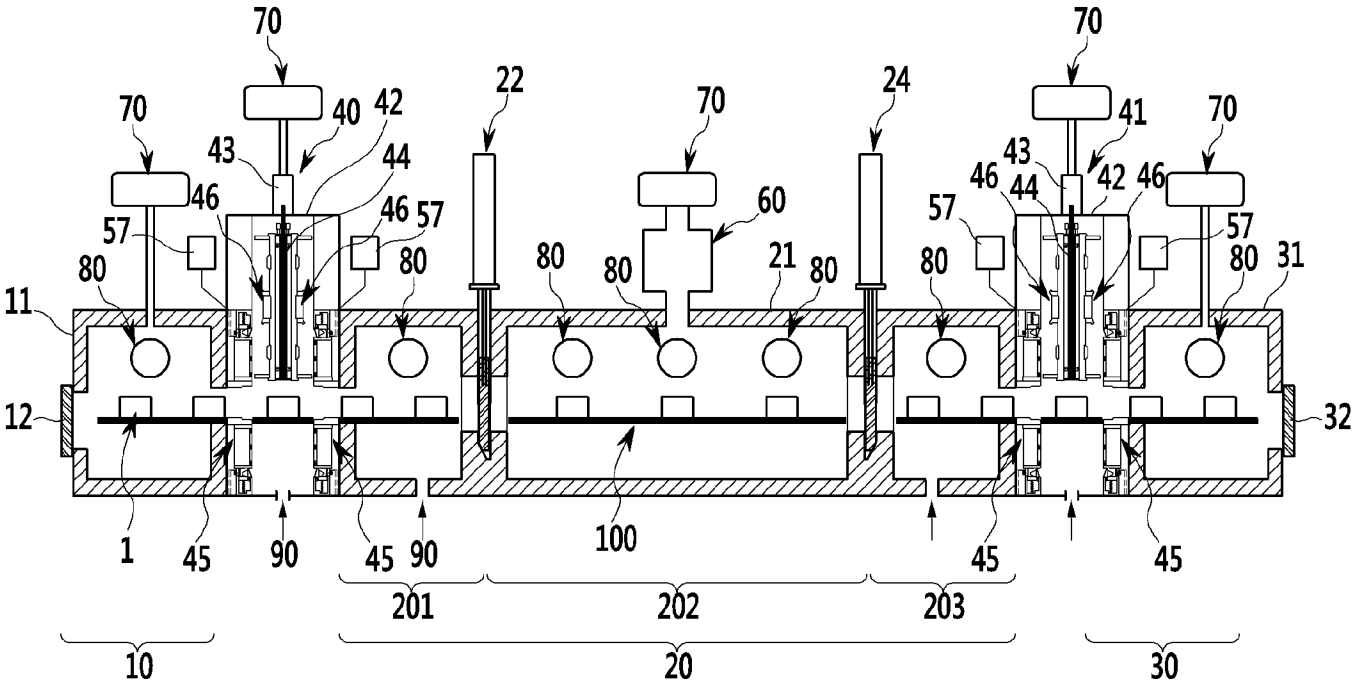
FIG. 5 is a schematic configuration diagram of a gate device of the thermal reduction apparatus according to the exemplary embodiment.

FIG. 5 is a schematic configuration diagram of the gate device of the thermal reduction apparatus according to the exemplary embodiment.

As illustrated in FIG. 5, the first gate device 40 and the second gate device 41 open and close a portion between the preheating unit and the reducing unit and a portion between the reducing unit and the cooling unit, thereby blocking gas and radiant heat in the reducing unit from flowing into the preheating unit or the cooling unit.

In the present exemplary embodiment, the first gate device 40 and the second gate device 41 are positioned at different positions, but may have the same structure. Therefore, in the following description, only the first gate device 40 will be described in detail, and a description of the second gate device 41 will be omitted.

Figure 6:
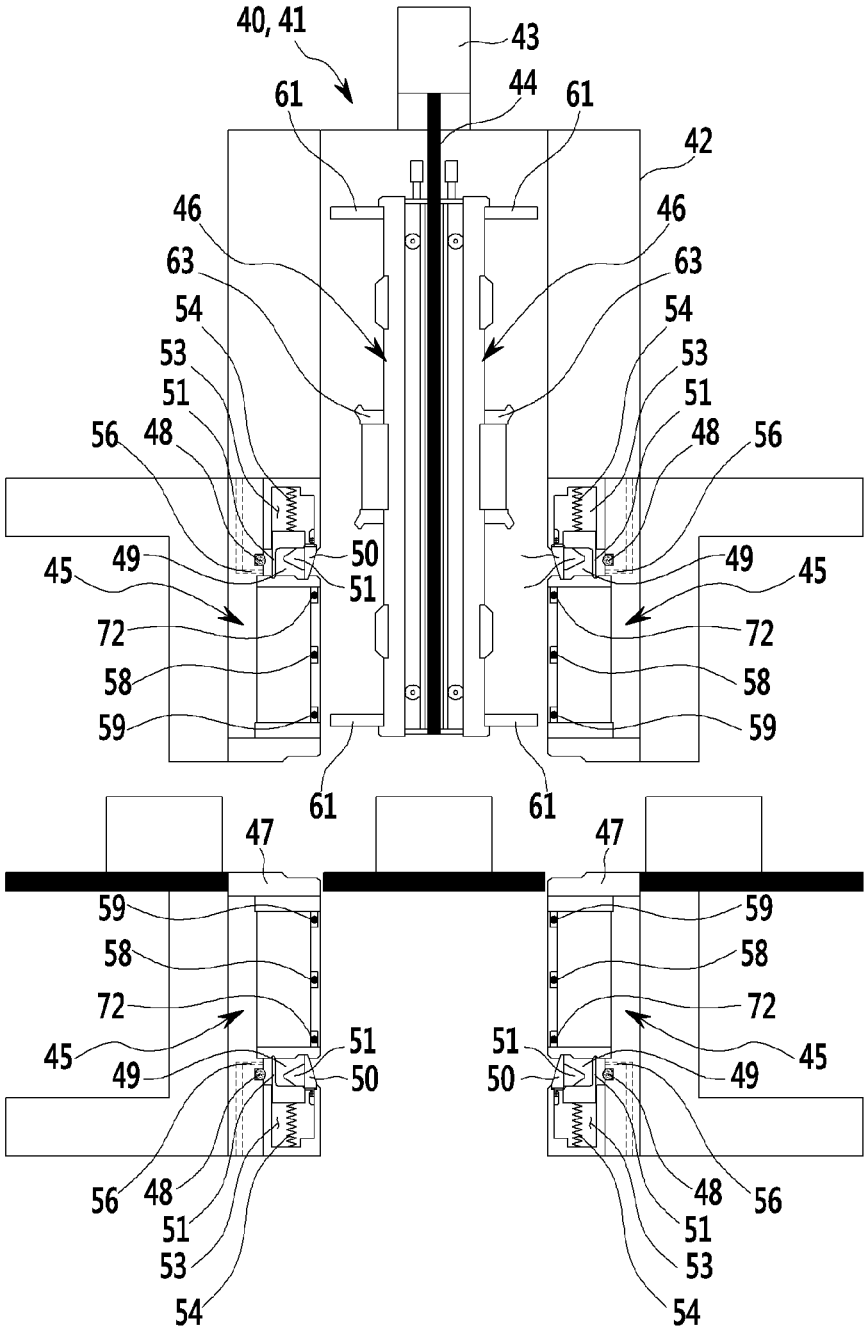
FIGS. 6 to 8 are schematic views illustrating a configuration of the gate device.

As illustrated in FIG. 6, the first gate device 40 includes: a valve housing 42 which is installed on a movement route of the to-be-reduced material and defines an internal space; valve body members 45 which are installed in the valve housing 42 and have a passage through which the to-be-reduced material passes; and a valve door unit which is movably installed in the valve housing 42 and selectively comes into close contact with the valve body members 45 to open and close the passage.

The valve housing 42 is a portion that defines a body of the first gate device 40, has a space therein, and is installed between the preheating unit body 11 and the reducing unit body 21.

The valve door unit includes: a vertical cylinder 43 which is installed at an upper end of the valve housing 42; a vertical beam 44 which is connected to the vertical cylinder 43 and moved upward and downward in the valve housing 42; and door plates 46 which are installed on the vertical beam 44 and come into close contact with the valve body members 45 while being moved in a horizontal direction toward the valve body members 45. Therefore, when the vertical cylinder 43 is extended or retracted, the door plates 46 are moved to the upper side of the valve housing 42 to open the valve body members 45 or moved downward to close the valve body members 45. In the valve housing 42, the conveying device 100 is connected to lower sides of the door plates 46 and thus may be moved upward and downward together with the door plate.

The door plates 46 are installed on the vertical beam 44 so as to be movable in the horizontal direction. The door plates 46 are moved downward as the vertical beam 44 is moved downward, and after the door plates 46 are completely moved downward, the door plates 46 are consecutively moved in a horizontal direction with respect to the vertical beam 44. Various structures such as rollers and link structures may be applied so that the door plates may be moved in the horizontal direction with respect to the vertical beam. Therefore, when the first gate device 40 is closed, the door plates 46 are moved downward together with the vertical beam 44 to be moved to the same position as the valve body members 45 as the vertical cylinder 43 is extended, and the door plates 46 are consecutively moved in the horizontal direction with respect to the vertical beam 44 and come into close contact with the valve body members 45. On the contrary, when the first gate device 40 is opened, the door plates 46 are moved in the horizontal direction so as to be spaced apart from the valve body members 45 while the vertical beam 44 is moved upward as the vertical cylinder 43 is retracted, and the door plates 46 are consecutively moved upward together with the vertical beam 44.

The valve body members 45 are installed on surfaces of the inner surface of the valve housing 42 which abut the preheating unit body and the reducing unit body, respectively. The valve body members 45 have a plate structure disposed vertically. The two valve body members 45 have the same structure, and are disposed opposite to each other so as to face each other. The valve door unit is disposed between two valve body members 45. The valve door unit also has the door plates 46 that are installed at both sides of the vertical beam 44 and directed toward the valve body members 45, respectively, and the door plates 46 come into close contact with the valve body members 45, respectively.

Since the two door plates 46 which come into close contact with the two valve body members 45 have the same structure as each other, any one of the valve body members 45 and any one of the door plates 46 will be described below.

The valve body member 45 includes: a frame 47 which forms a passage; a sealing member 48 which is installed along a circumference of the frame 47 so as to be spaced apart from the frame 47 and comes into close contact with the valve door unit to maintain air-tightness; and a blocking unit which selectively blocks a portion between a groove in which the sealing member 48 is installed and the inside of the valve housing 42.

The frame 47 is installed on the valve body member 45 at a position corresponding to a movement line of the to-be-reduced material. The frame 47 communicates with the preheating unit body to form the passage through which the to-be-reduced material passes. The sealing member 48 seals two members between the valve body member 45 and the valve door unit. For example, the sealing member 48 may be an O-ring. The sealing member 48 is spaced apart from the frame 47 which forms the passage by a predetermined distance, and is installed along the circumference of the frame 47.

A groove 49 is deeply formed in the valve body member 45 to form a space in which the sealing member 48 is installed, and the sealing member 48 is installed in the groove 49.

The space which is formed by the groove 49 and has the sealing member 48 installed therein is isolated from the inside of the valve housing 42 by the blocking unit. Therefore, the blocking unit blocks reduced vapor which flows into the valve housing 42 from the reducing unit during the processes of opening and closing the first gate device 40, thereby preventing the reduced vapor from moving to the sealing member 48. Therefore, it is possible to prevent the metal vapor from the reducing unit from being deposited on the sealing member 48.

The blocking unit blocks the groove 49 when the door plate 46 of the valve door unit is separated from the valve body member 45, and the blocking unit is opened when the door plate 46 comes into close contact with the valve body member 45.

In the present exemplary embodiment, the blocking unit may include: a first curtain 50 which is rotatably installed in the valve body member 45 and blocks the groove 49 in which the sealing member 48 is installed; and a second curtain 51 which is installed between the sealing member 48 and the first curtain 50 and blocks the groove 49.

Figure 7:
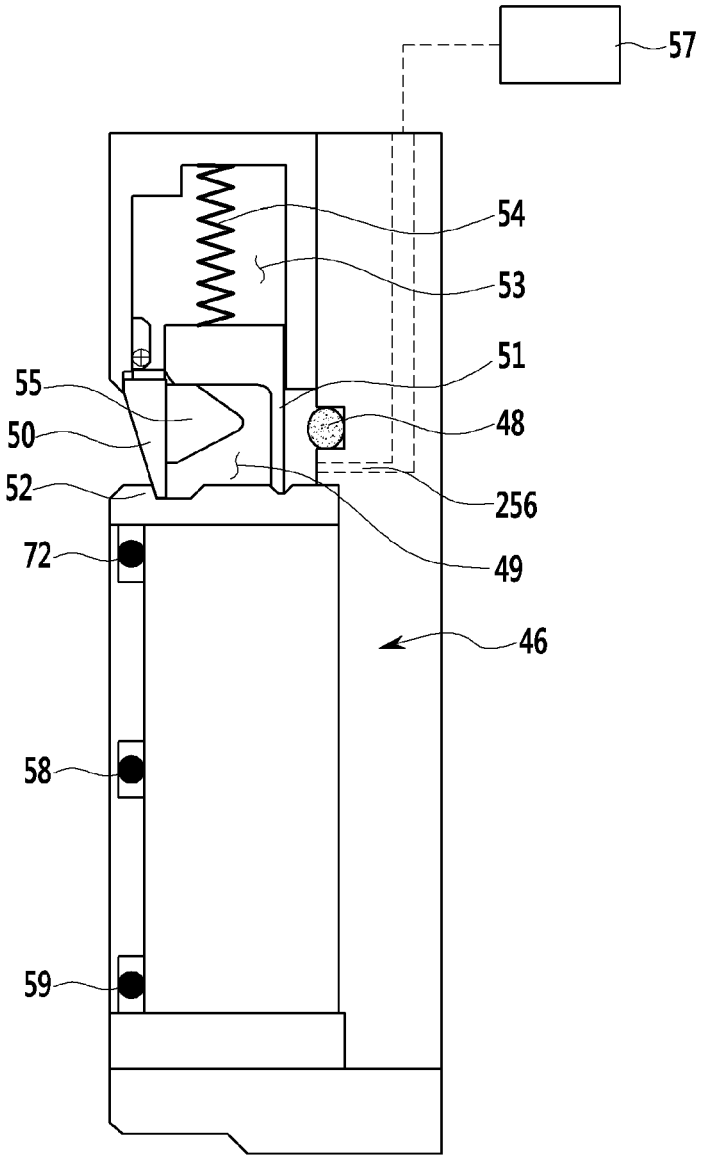

As illustrated in FIG. 7, the first curtain 50 is disposed along the groove 49. One end of the first curtain 50 is coupled to the valve body member 45 by means of a shaft, and as a result, the first curtain 50 is rotatably installed. The first curtain 50 has a structure that is rotated toward the inside of the groove 49. A stepped portion 52 is formed in the groove 49 so that a free end opposite to the tip of the first curtain 50, which is coupled by means of a shaft, is caught by the stepped portion 52 so as to not be rotated to the outside of the groove 49. Therefore, the first curtain 50 cannot be rotated to the outside of the groove 49 because the free end is caught by the stepped portion 52, but can only be rotated inside the groove 49.

The second curtain 51 is installed so as to be rectilinearly moved in a direction perpendicular to the groove 49, and blocks the groove 49. A space 53 is formed in the valve body member 45 so that the second curtain 51 is moved in the space 53. The second curtain 51 is disposed in the space and opens and closes the groove 49 while reciprocating. A spring 54, which applies elastic force to the second curtain 51, is installed in the space 53. Therefore, the second curtain 51 is moved toward the groove 49 by being pushed by elastic force of the spring 54, and blocks the groove 49.

The first curtain 50 and the second curtain 51 are organically connected to each other and operated in conjunction with each other. That is, the second curtain 51 rectilinearly moves while the first curtain 50 rotates, and the first curtain 50 rotates while the second curtain 51 rectilinearly moves. The spring 54 installed in the space applies elastic force so that the second curtain 51 is closed, and the first curtain 50, which is operated in conjunction with the second curtain 51, is also rotated by the elastic force of the spring 54 in a direction in which the first curtain 50 is closed, thereby maintaining a blocked state of the groove 49.

For the purpose of cooperation between the first curtain 50 and the second curtain 51, a cooperating bar 55, which abuts the second curtain 51 and pushes up the second curtain 51, protrudes from an inner surface of the first curtain 50. Therefore, when the first curtain 50 is rotated toward the inside of the groove 49 by the valve door unit, the cooperating bar 55 moves and pushes up the second curtain 51. Therefore, the second curtain 51 is rectilinearly moved into the space and opens the groove 49. When the second curtain 51 is moved into the space, the spring 54 installed in the space applies elastic force to the second curtain 51 while being compressed. When external force which is applied to the first curtain 50 by the valve door unit is removed, the second curtain 51 is rectilinearly moved by elastic restoring force of the compressed spring 54 and blocks the groove 49. As the second curtain 51 is moved, the cooperating bar 55 of the first curtain 50 is pushed, such that the first curtain 50 is also rotated. Therefore, the first curtain 50 also blocks the groove 49. The first curtain 50 and the second curtain 51 come into close contact with the groove 49 by the elastic force of the spring 54, thereby blocking the groove 49 from the inside of the valve housing 42.

As described above, the groove 49 is doubly blocked by the two curtains, and as a result, it is possible to perfectly block the metal vapor from flowing into the sealing member 48 installed in the groove 49.

In addition, the blocking unit may further include: a gas pipe 56 through which the inert gas is injected into the groove 49 in which the sealing member 48 is installed, and a gas supply unit 57 which supplies the inert gas into the gas pipe 56. The gas pipe 56 is installed to be connected to the groove 49 through the valve housing 42 and the inside of the valve body member 45. The gas pipe 56 may have a structure that injects gas between the second curtain 51 and the sealing member 48.

When the first curtain 50 and the second curtain 51 are opened, the inert gas is supplied into the groove 49 through the gas pipe 56. Therefore, an inert gas environment is formed at the periphery of the sealing member 48. The inert gas being injected into the sealing member 48 blocks the metal vapor from instantaneously flowing into the groove 49 when the first curtain 50 and the second curtain 51 are opened.

The valve body member may further include a thermal resistance unit which is installed between the frame 47 and the sealing member 48, and forms a temperature gradient in the internal space of the valve housing 42 so as to block the reduced vapor from being moved toward the sealing member 48.

As illustrated in FIG. 7, the thermal resistance unit includes: a heating wire 58 which is installed in the valve body member 45 and forms a high-temperature region; and a primary coolant pipe 59 and a secondary coolant pipe 72 which are spaced apart from the heating wire and installed inside and outside at the periphery of the heating wire so as to form a low-temperature region.

The heating wire 58 applies heat to form the high-temperature region in the valve housing 42 at a corresponding position. The primary coolant pipe 59 and the secondary coolant pipe 72 form the low-temperature region in the valve housing 42 at corresponding positions.

Since the two valve body members 45 are disposed opposite to each other so as to face each other in the valve housing 42, a temperature gradient layer is formed between the two valve body members 45 by the thermal resistance units. Because of thermodynamic characteristics in that a fluid flows from the high-temperature region to the low-temperature region according to a temperature gradient, the fluid is difficult to flow in a case in which there is a thermal resistance layer with a temperature gradient.

The temperature gradient layer is formed between the sealing member 48 and the frame 47 that is a passage. As described above, a temperature gradient layer is artificially formed between the frame 47 and the sealing member 48 to allow thermal resistance to occur, and as a result, the thermal resistance unit may prevent the metal vapor flowing into the valve housing 42 from the passage from being moved toward the sealing member 48.

Figure 8:
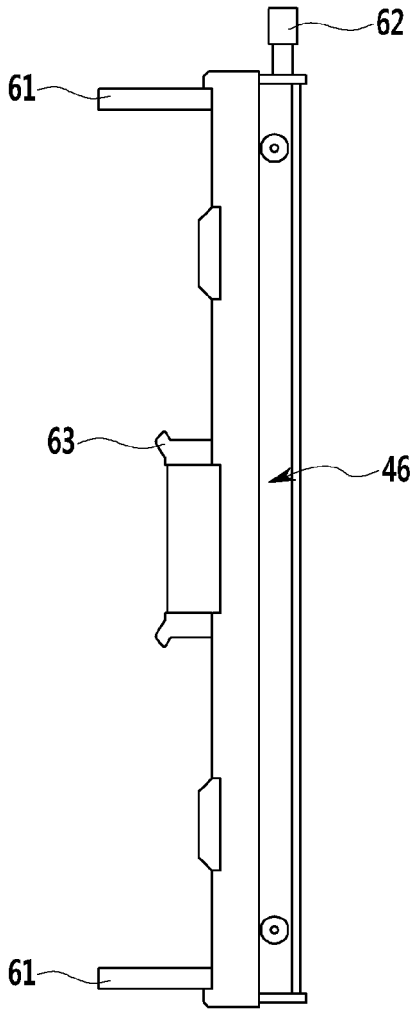

As illustrated in FIG. 8, the door plate 46, which comes into close contact with the valve body member 45, has a size roughly corresponding to the size of the valve body member 45. The door plate 46 is moved in the horizontal direction to the valve body member 45 and comes into close contact with the valve body member 45 with the sealing member 48 interposed therebetween.

Close contact members 61, which are moved into the grooves 49 in which the sealing members 48 are installed and come into close contact with the sealing members 48, protrude from a front surface of the door plate 46 which is directed toward the valve body member 45.

Each close contact member 61 is sized to be moved into the groove 49 and has a sufficient length to allow the close contact member 61 to come into contact with the sealing member 48. Therefore, when the door plate 46 is moved toward the valve body member 45, the passage of the valve body member 45 is blocked, and the close contact member 61 is moved into the groove 49 and then comes into close contact with the sealing member 48 installed in the groove 49. Therefore, a portion between the valve body member 45 and the door plate 46 is completely sealed by the sealing member 48, thereby blocking a leak of metal vapor or radiant heat.

Here, the close contact member 61 pushes the first curtain 50 installed in the groove 49 while moving into the groove 49. The first curtain 50 opens the groove 49 while being rotated by being pushed by the close contact member 61. When the first curtain 50 is rotated, the cooperating bar 55 installed on the first curtain 50 pushes up the second curtain 51. Therefore, the second curtain 51 is also opened, and the close contact member 61 completely moves into the groove 49 without interference with the second curtain 51 and comes into close contact with a sealing pad.

A cooling jacket (not illustrated) is installed in the door plate 46. A feeding pipe 62 through which a coolant is supplied to the cooling jacket is installed at an upper side of the door plate 46. The door plate 46 is cooled by the cooling jacket, thereby protecting the door plate 46 from a high temperature.

In addition, the valve door unit according to the present exemplary embodiment has a structure that removes the reduced metal deposited on the frame 47 when the door plate 46 comes into close contact with the valve body member 45 or the door plate 46 moves away from the valve body member 45. To this end, a skimmer 63 is installed on the door plate 46 at a position corresponding to the frame 47. The skimmer 63 protrudes from the door plate 46 to the outside. The skimmer 63 has a structure that abuts an inner surface of the frame 47 and scrapes the reduced metal condensed on an inner circumferential surface of the frame 47 off the inner circumferential surface.

The skimmer 63 has the same shape as an inner surface of the frame 47. An outer tip of the skimmer 63 serves as a blade that comes into close contact with the inner surface of the frame 47 and scrapes the reduced metal. Accordingly, when the door plate 46 is moved to the valve door unit, the skimmer 63, which protrudes from the door plate 46, scrapes the inner surface of the frame 47 while being moved to the inside of the frame 47. Therefore, it is possible to remove the reduced metal condensed on the inner surface of the frame 47 during the processes of opening and closing the door plate 46.

In addition, the first gate device 40 may further include a vacuum device 70 which is installed in the valve housing 42. The vacuum device may be a vacuum pump.

Hereinafter, a thermal reduction process according to the exemplary embodiment of the present invention will be described.

In the following description, an example in which the to-be-reduced material is a fired body produced when a magnesium briquette is fired together with a reductant will be described. The present exemplary embodiment is not limited thereto, and may be applied to processes of reducing various types of metal.

When the to-be-reduced material 1 is loaded into the preheating unit, the first door 12 is closed, and the to-be-reduced material is preheated. When the preheating is completed, the first gate device 40 disposed between the preheating unit and the reducing unit is opened, and the to-be-reduced material is loaded into the reducing unit 20. The to-be-reduced material 1 is loaded into the first space 201 of the reducing unit from the preheating unit. In this case, the first blocking unit 22 is closed.

Figure 9:
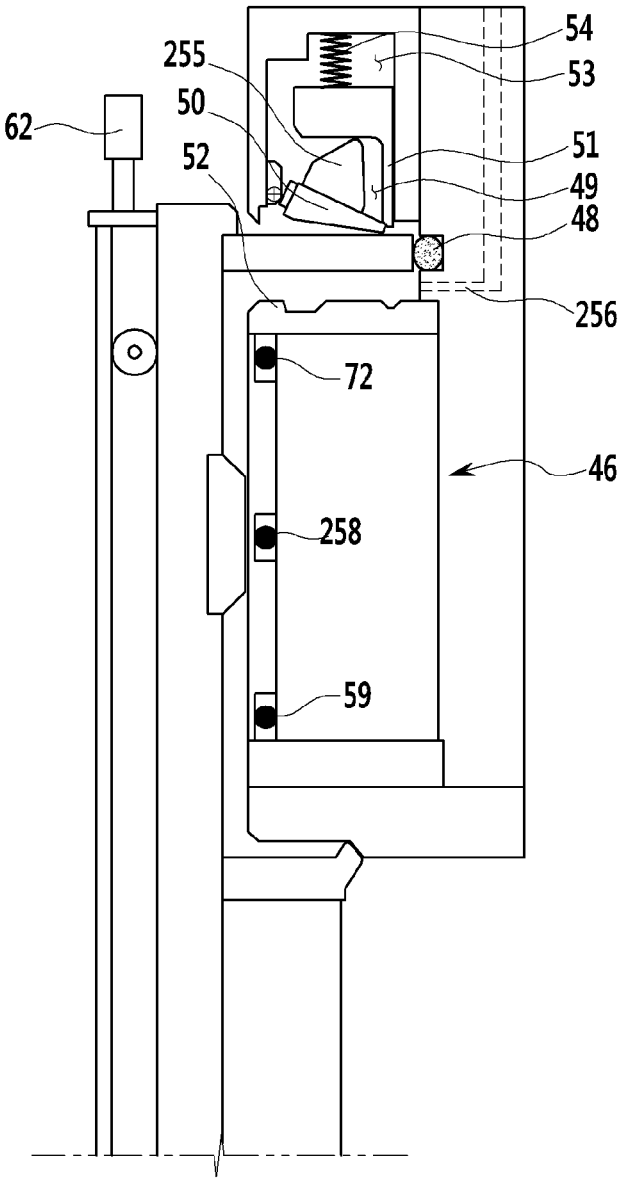
FIGS. 9 to 11 are views sequentially illustrating states in which the gate device is operated.
Figure 10:
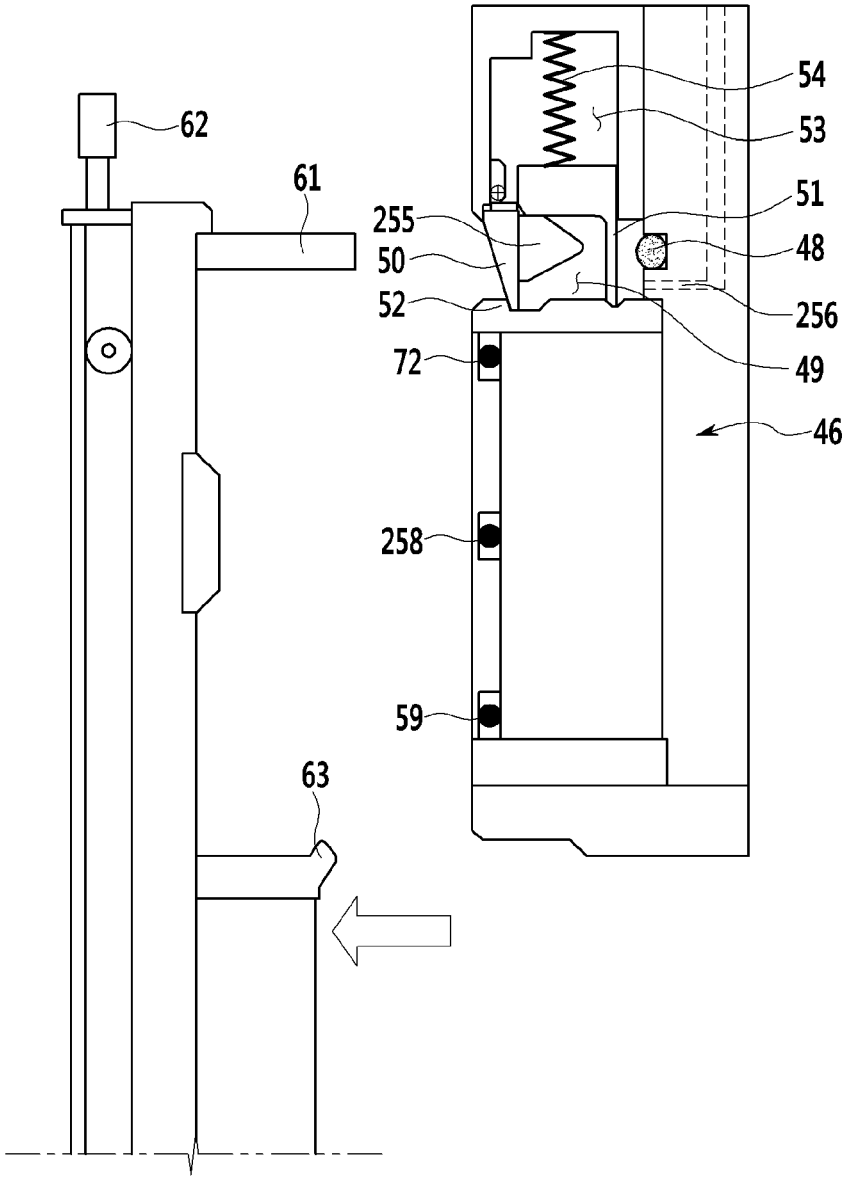
Figure 11:
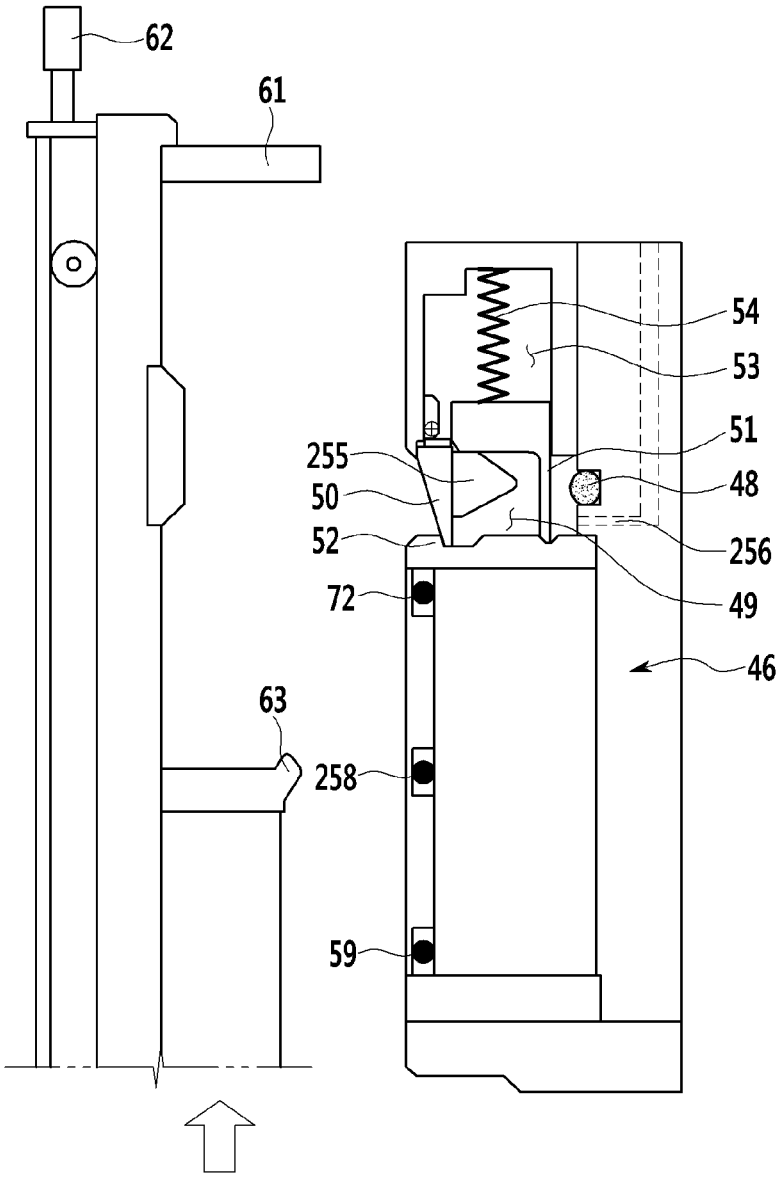

FIGS. 9 to 11 illustrate a process of opening the first gate device 40. As illustrated in FIG. 9, when the door plate 46 is closed to the valve body member 45, the skimmer 63 installed on the door plate 46 is inserted into the frame 47 and completely blocks the passage formed by the frame 47. Further, the close contact member 61 installed on the door plate 46 is moved into the groove 49 and comes into close contact with the sealing member 48 installed in the groove 49. Therefore, a portion between the door plate 46 and the close contact member 61 is sealed by the sealing member 48. The first curtain, which blocks the groove 49, is rotated by being pushed by the close contact member 61, and the second curtain is pushed upward by the cooperating bar 55 of the first curtain being rotated, and moved into the space. As the second curtain is pushed upward, the spring 54 is compressed by the second curtain.

In this state, as the first gate device 40 is opened, the door plate 46 is moved in the horizontal direction and spaced apart from the valve door unit, as illustrated in FIG. 10. As the door plate 46 is moved, the skimmer 63 and the close contact member 61 are withdrawn from the frame 47 and the groove 49, respectively. As the close contact member 61 is withdrawn from the groove 49, external force applied to the first curtain 50 is removed, and the first curtain 50 is rotated to an original position. Since the first curtain receives elastic force of the spring 54 through the second curtain, when the close contact member 61 is withdrawn from the groove 49, the first curtain is rotated by elastic restoring force of the spring 54 until the first curtain is caught by the stepped portion 52 formed in the groove 49, and blocks the groove 49. As the first curtain is rotated to the original position, the cooperating bar 55 is also moved, and the second curtain is also moved toward the groove 49 by elastic restoring force of the spring 54. When the close contact member 61 is completely moved from the groove 49, the first curtain and the second curtain abut the groove 49 and completely block the groove 49, as illustrated in FIG. 10. Therefore, it is possible to prevent the reduced vapor, which flows out through the frame 47 during the process of opening the door plate 46, from being moved toward the sealing member 48.

As illustrated in FIG. 11, the door plate 46 is completely moved in the horizontal direction with respect to the valve body member 45, separated from the valve body member 45, and then moved upward. As the door plate 46 which blocks the frame 47 of the valve body member 45 is moved upward, the passage of the first gate device is completely opened.

The to-be-reduced material in the preheating unit is loaded into the first space of the reducing unit through the opened first gate device 40.

When the to-be-reduced material 1 is completely loaded into the first space 201, the first gate device 40 disposed between the preheating unit and the reducing unit is closed and the first blocking unit 22 is opened, such that the to-be-reduced material is loaded into the second space 202. In this case, the second blocking unit 24 is closed to block an outflow of the metal vapor and heat transfer.

The to-be-reduced material 1 is reduced in the form of metal vapor in the second space 202, and the reduced metal vapor is condensed by the condensing device 60. The second space 202 is maintained in a vacuum state, and the temperature range in the second space 202 may be maintained at 1100° C. to 1300° C. In a state in which the second space 202 is blocked by the first blocking unit 22 and the second blocking unit 24, the metal vapor may be reduced in the closed space without a leak of gas or radiant heat.

When the reduction of the to-be-reduced material 1 is completed, the second blocking unit 24 is opened, and the to-be-reduced material is loaded into the third space 203. When the to-be-reduced material 1 is completely moved into the third space, the second blocking unit 24 is closed.

When the to-be-reduced material 1 is completely loaded into the third space 203, the second gate device 41 installed between the reducing unit and the cooling unit is opened, and the to-be-reduced material is moved to the cooling unit 30 placed in a vacuum state. The process of opening the second gate device 41 is the same as the aforementioned process of opening the first gate device 40.

When the cooling of the to-be-reduced material is completed, pressure in the cooling unit is converted to normal pressure and then the second door 32 is opened, and the to-be-reduced material is unloaded. As described above, at least one to-be-reduced material may be thermally reduced while being continuously loaded and unloaded.

[Condensing System]

Hereinafter, a configuration of a condensing system provided in the thermal reduction apparatus according to the present exemplary embodiment will be described. The condensing device 60 of the thermal reduction apparatus according to the exemplary embodiment illustrated in FIG. 1 and the condensing device 260 of the thermal reduction apparatus according to the exemplary embodiment illustrated in FIG. 3 have the same structure. Therefore, in the following description, only the condensing device 60 according to the exemplary embodiment illustrated in FIG. 1 will be described, and a description of the condensing device 260 according to the exemplary embodiment illustrated in FIG. 3 will omitted. In the following description, constituent elements which are identical to the constituent elements that have been already described are designated by the same reference numerals, and a detailed description thereof will be omitted. In the following description, an example in which the condensing device condenses magnesium will be described. The present exemplary embodiment is not limited thereto, but may be applied to processes of reducing various types of metal.

Figure 12:
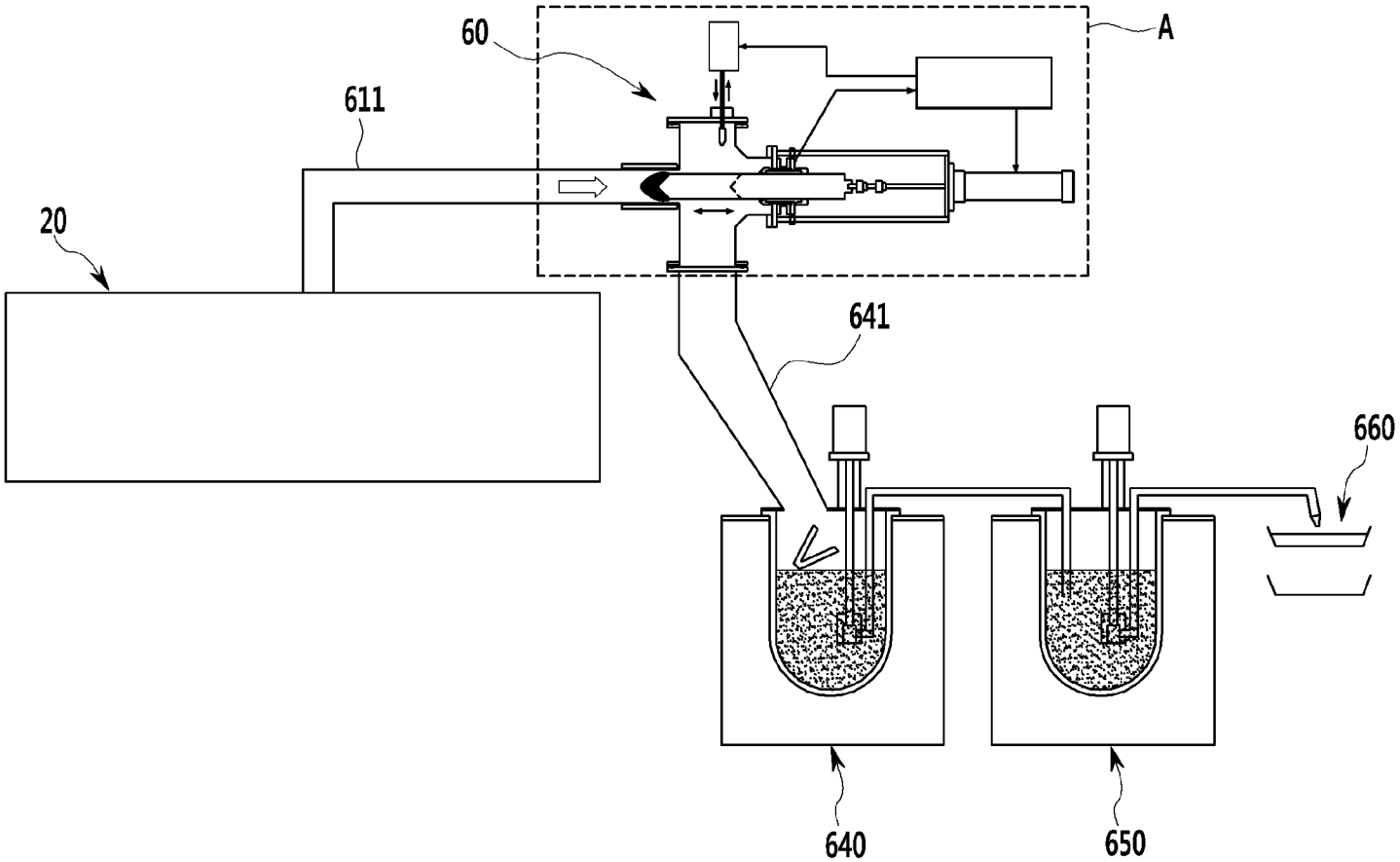
FIG. 12 is a configuration diagram of a thermal reduction apparatus to which a single condensing device according to the exemplary embodiment is applied.

As illustrated in FIG. 12, only one magnesium condensing device 60 is provided, and as a result, the magnesium condensing device 60 according to the present exemplary embodiment may be configured as a single system installed in the thermal reduction apparatus.

Other than the aforementioned structure, a multi-type magnesium condensing system including two or more condensing devices may be established to allow magnesium crowns to be discharged from the plurality of condensing devices, thereby increasing a production rate. The multi-type magnesium condensing system will be specifically described below.

The magnesium condensing device 60 is connected to the reducing unit 20 through a magnesium vapor discharge pipe 611. Therefore, magnesium gas generated in the reducing unit 20 flows into the magnesium vapor discharge pipe 611.

In addition, the magnesium condensing device 60 is connected to a melting furnace 640 through a magnesium crown discharge pipe 641, and the condensed magnesium crown is discharged from the magnesium condensing device 60 to the melting furnace 640 through the magnesium crown discharge pipe 641.

Here, the magnesium crown is melted in the melting furnace 640, and molten magnesium, which is produced by melting the magnesium crown in the melting furnace 640, is supplied to a refining furnace 650.

The molten magnesium supplied from the melting furnace 640 is refined in the refining furnace 650, and a casting machine 660 coupled to the refining furnace 650 is supplied with the refined molten magnesium from the refining furnace 650 such that ingots are casted in the casting machine 660.

Figure 13:
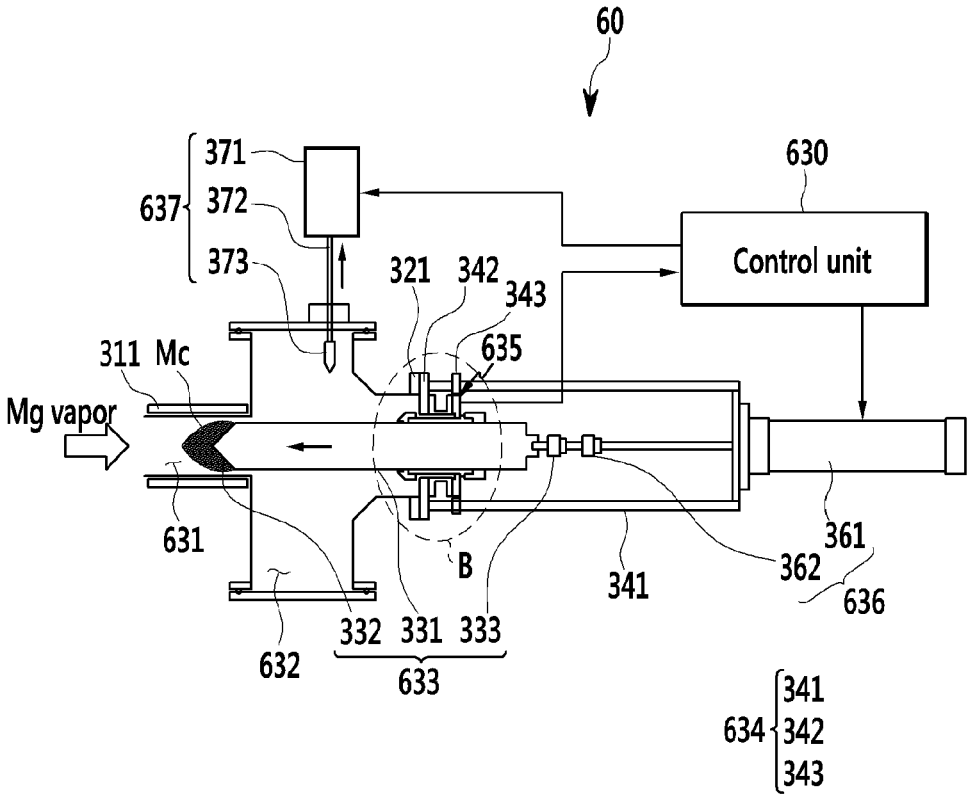
FIGS. 13 and 14 are enlarged views of part A in FIG. 12, and illustrate configuration diagrams of the single condensing device according to the exemplary embodiment of the present invention.

FIG. 13 is an enlarged view of part A in FIG. 12, which illustrates a configuration diagram of the magnesium condensing device according to the exemplary embodiment of the present invention.

Referring to FIG. 13, the magnesium condensing device 60 according to the present exemplary embodiment includes an inlet pipe 631, a magnesium collecting chamber 632, a condenser 633, a housing 634, a magnesium weight measuring unit 635, a condenser moving unit 636, and a scraper 637. In this case, FIG. 13 illustrates a state in which a part of the condenser 633 is inserted into a part of the inlet pipe 631 and positioned at a magnesium vapor condensing position.

The magnesium vapor generated in the reducing unit 20 flows into the inlet pipe 631 through the magnesium vapor discharge pipe 611.

In this case, a heater 311 is installed on an outer circumferential surface of the inlet pipe 631 and heats the magnesium vapor flowing into the inlet pipe 631.

In addition, the magnesium collecting chamber 632 having a hollow space is coupled to one end of the inlet pipe 631. The magnesium collecting chamber 632 has an internal space having a cross shape, the inlet pipe 631 and the condenser moving unit 636 are positioned in the horizontal direction (in a front and rear direction) of the magnesium collecting chamber 632, and the scraper 637 and the magnesium crown discharge pipe 641 are positioned in a vertical direction (in an up and down direction) of the magnesium collecting chamber 632.

The condenser 633 includes: a condenser main body 331 which penetrates the magnesium collecting chamber 632; a magnesium condensing unit 332 which is formed at a tip of the condenser main body 331 and positioned at the magnesium vapor condensing position in the inlet pipe 631 to condense the magnesium crown MC; and a condenser articulated joint 333 which is installed at the other end of the magnesium condensing unit 332.

That is, one end of the condenser 633, which is configured as the magnesium condensing unit 332, is positioned in the inlet pipe 631, and the other end of the condenser 633, which is positioned opposite to the one end, is installed in the horizontal direction so as to penetrate the magnesium collecting chamber 632.

In this case, although omitted in the drawing, a coolant supply and discharge line is formed in the condenser 633 to cool the magnesium condensing unit 332, thereby condensing the magnesium crown MC at a tip of the magnesium condensing unit 332 which is in contact with the magnesium vapor.

The housing 634 is coupled to an opening of the magnesium collecting chamber 632. The housing 634 includes a housing main body 341, a housing flange 342, and an intermediate member 343.

The condenser articulated joint 333 is positioned in the housing main body 341, and the housing flange 342 extends from one end of the housing main body 341 and is coupled to a chamber flange 321 formed at the periphery of the opening of the magnesium collecting chamber 632.

The magnesium weight measuring unit 635 is installed between the condenser 633 and the housing 634, and measures a weight of the magnesium crown MC condensed on the magnesium condensing unit 332 of the condenser 633.

The condenser moving unit 636 is installed at one end of the housing 634 and coupled for the purpose of the horizontal movement of the condenser 633.

The condenser moving unit 636 moves the condenser 633 forward depending on a control signal from a control unit 630 so as to move the condenser 633 to the magnesium vapor condensing position in the inlet pipe 631, and when the weight of the magnesium crown MC which is measured by the magnesium weight measuring unit 635 exceeds a set value, the condenser moving unit 636 is operated to retract the condenser 633 to a position for removing the magnesium crown MC.

To this end, the condenser moving unit 636 includes: a condenser moving unit main body 361; and a moving unit articulated joint 362 which is coupled to one end of the condenser moving unit main body 361 and coupled to the condenser articulated joint 333.

Therefore, since the condenser articulated joint 333 of the condenser 633 and the moving unit articulated joint 362 of the condenser moving unit 636 are coupled to each other, it is possible to ensure fluidity corresponding to fluidity of the condenser 633 according to an increase in weight of the magnesium crown MC.

The scraper 637 includes: a scraper main body 371 which is installed while penetrating the magnesium collecting chamber 632; a shaft 372 which is coupled to the scraper main body 371; and a removing unit 373 which is coupled to one end of the shaft 372.

Based on a control signal applied to the scraper 637, the scraper 637 removes the magnesium crown MC condensed on the magnesium condensing unit 332 of the condenser 633.

Figure 14:
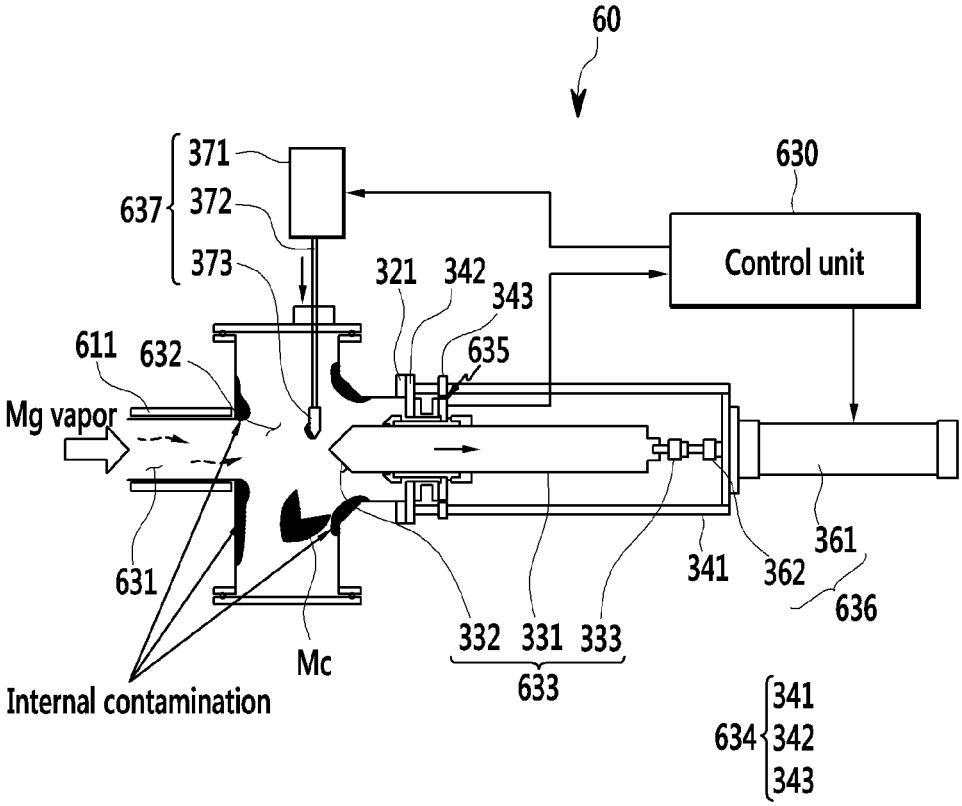

FIG. 14 illustrates a state in which the condenser of the condensing device is positioned at the position for removing the magnesium crown.

Referring to the attached FIG. 14, the control unit 630 according to the present exemplary embodiment measures the weight of the magnesium crown MC in real time using the magnesium weight measuring unit 635, and controls the movement of the condenser moving unit 633.

That is, when the weight of the magnesium crown MC exceeds a set value, the control unit 630 may move the condenser 633 to the position for removing the magnesium crown MC by retracting the condenser 636.

Further, the control unit 630 may separate the magnesium crown MC from the condenser 633 using the removing unit 373 by adjusting a length of the shaft 372 of the scraper 637.

In the case of a condensing system having a plurality of condensing devices 60 according to the exemplary embodiment of the present invention, the plurality of condensing devices have structures that are independently separated from each other, such that the magnesium crowns MC removed from the condensers 633 may be supplied to independent melting furnaces 640, respectively, or may be supplied to a single melting furnace 640 through a common magnesium crown discharge pipe 641.

In addition, when all of the magnesium crowns MC are separated (removed) from the condenser 633, the control unit 630 controls the condenser moving unit 636 so as to move the condenser 633 to the magnesium vapor condensing position in the inlet pipe 631.

According to the present exemplary embodiment, it is possible to conveniently and automatically condense the magnesium crown MC on the magnesium condensing unit 332 of the condenser 633 and separate the condensed magnesium crown MC.

Hereinafter, the magnesium weight measuring unit 635 according to the present exemplary embodiment, which measures the weight of the magnesium crown MC condensed on the magnesium condensing unit 332, will be described in detail.

Figure 15:
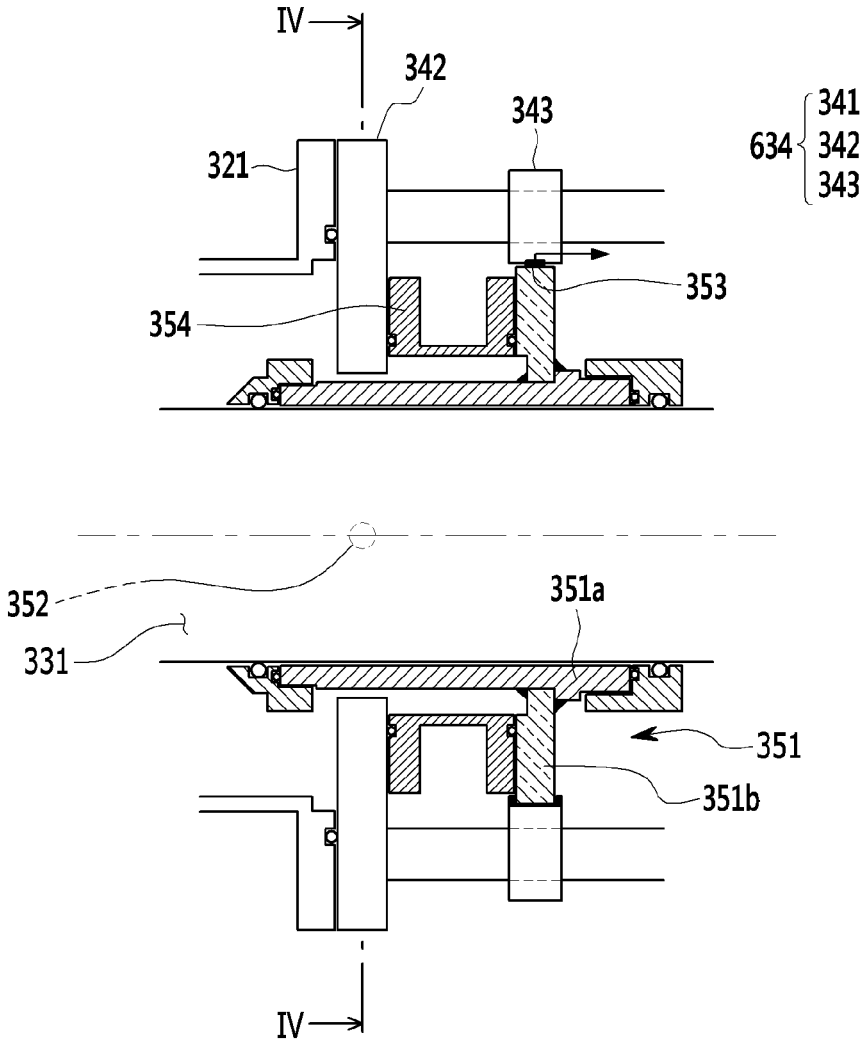
FIG. 15 is an enlarged view of part B in FIG. 13, and illustrates a configuration diagram of a magnesium weight measuring unit of the condensing device according to the exemplary embodiment of the present invention.
Figure 16:
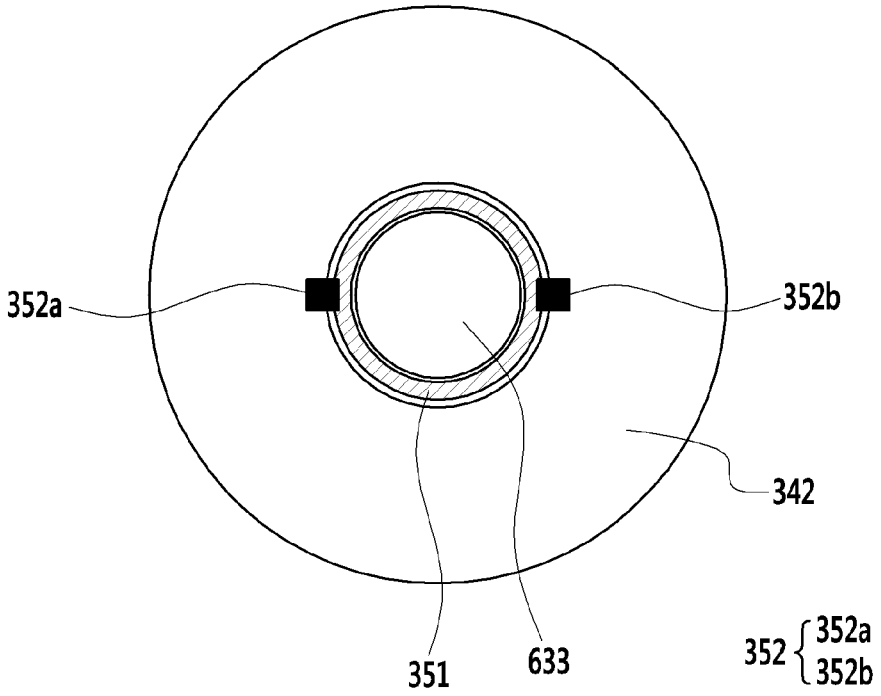
FIG. 16 is a cross-sectional view taken along line IV-IV of FIG. 15.

FIG. 15 is an enlarged view of part B in FIG. 13, which illustrates a configuration diagram of the magnesium weight measuring unit of the magnesium condensing device according to the exemplary embodiment of the present invention, and FIG. 16 is a cross-sectional view taken along line IV-IV of FIG. 15.

Referring to FIGS. 15 and 16, the magnesium weight measuring unit 635 according to the present exemplary embodiment includes a sleeve 351, a swinging shaft 352, a load cell 353, and a bellows 354.

The sleeve 351 is coupled to an outer circumferential surface of the condenser main body 331 of the condenser 633.

In more detail, the sleeve 351 includes: a sleeve main body 351*a* which is coupled to the outer circumferential surface of the condenser main body 331 so that the condenser main body 331 is movable; and a sleeve protrusion 351*b* which extends from the sleeve main body 351*a*.

In addition, the swinging shaft 352 is positioned between the sleeve 351 and the housing 634, and connects the sleeve 351 and the housing 634.

In more detail, the swinging shaft 352 according to the present exemplary embodiment is installed between the housing flange 342 of the housing 634 and the sleeve main body 351*a*, and connects the housing flange 342 and the sleeve main body 351*a*.

In addition, the swinging shaft 352 may include: a first swinging shaft 352*a*; and a second swinging shaft 352*b* which is positioned opposite to the first swinging shaft 352*a*, and the first swinging shaft 352*a* and the second swinging shaft 352*b* may be installed at positions that are symmetrical to each other based on a central point of the swinging shaft 352.

Therefore, the condenser 633 according to the present exemplary embodiment swings about the swinging shaft 352.

In more detail, since the weight of the magnesium crown MC is increased as the magnesium crown MC is condensed on the magnesium condensing unit 332 of the condenser 633, the magnesium condensing unit 332 is moved downward in a gravitational direction.

Therefore, the magnesium condensing unit 332 rotates counterclockwise about the swinging shaft 352.

As a result, according to the present exemplary embodiment, as the weight of the magnesium crown MC is increased, the condenser 633 swings about the swinging shaft 352.

In this case, the swinging shaft 352 may also swing by the swing movement of the condenser 633.

In addition, the load cell 353 is coupled to the sleeve 351, receives the swing movement of the condenser 633, and measures the weight of the magnesium crown MC condensed at one end of the magnesium condensing unit 332.

In more detail, the load cell 353 according to the present exemplary embodiment is installed on the sleeve protrusion 351*b* so that one surface of the load cell 353 is in contact with the intermediate member 343 coupled to the housing main body 341.

Here, one surface of the intermediate member 343, which is in contact with the load cell 353, is fixed to the housing main body 341, and the other surface of the intermediate member 343, which is positioned opposite to the one surface in contact with the load cell 353, is coupled to be movable in a width direction of the housing main body 341.

That is, according to the present exemplary embodiment, when the swing movement of the condenser 633 is transmitted to the intermediate member 343 via the swinging shaft 352, the housing flange 342, and the housing main body 341, the one surface of the intermediate member 343, which is fixed to the housing main body 341, presses the load cell 353.

In this case, the weight of the magnesium crown MC, which corresponds to pressing pressure applied by the intermediate member 343, is calculated by the load cell 353, and the calculated weight is transmitted to the control unit 630.

In addition, when the weight of the magnesium crown MC is equal to or greater than a predetermined weight, the control unit 630 operates the condenser moving unit 636 to move the condenser 633 so that the magnesium condensing unit 332 is positioned to be far away from the inlet pipe 631.

In addition, the bellows 354 is installed between the housing flange 342 and the sleeve 351.

In more detail, the bellows 354 is installed between the housing flange 342 and the sleeve protrusion 351*b*.

The bellows 354 according to the present exemplary embodiment is installed between the housing 634 and the sleeve 351 and blocks the magnesium vapor in the inlet pipe 631, the magnesium collecting chamber 632, and the housing 634 from coming into contact with outside air.

Therefore, according to the present exemplary embodiment, the condenser 633 swings about the swinging shaft 352 so as to correspond to the weight of the magnesium crown MC condensed on the magnesium condensing unit 332 of the condenser 633, and the swing movement of the condenser 633 is applied to the load cell 353 via the swinging shaft 352 and the intermediate member 343, such that the weight of the magnesium crown MC condensed on the magnesium condensing unit 332 may be measured by the load cell 353.

In addition, the control unit 630 determines whether to operate the condenser moving unit 636 and the scraper 637 depending on the weight of the magnesium crown MC which is measured by the load cell 353.

That is, when the weight of the magnesium crown MC is equal to or greater than a predetermined weight, the control unit 630 operates the condenser moving unit 636 and the scraper 638 to remove the magnesium crown MC from the magnesium condensing unit 332, and thereafter, the control unit 630 operates the condenser moving unit 636 so that the magnesium condensing unit 332 is positioned in the inlet pipe 631.

As a result, according to the present exemplary embodiment, it is possible to repeatedly and automatically separate the magnesium crown MC condensed on the magnesium condensing unit 332, and it is possible to separate the magnesium crown MC from the condenser 633 without separating the condenser 633 from the magnesium condensing device 60.

Therefore, the present exemplary embodiment may provide the magnesium condensing device capable of improving efficiency in producing magnesium by simplifying a magnesium process, and reducing costs required to produce magnesium by allowing the magnesium condenser to be used repeatedly.

Meanwhile, in a case in which the single condensing device 60 is used, there is a merit in that the condensation of the magnesium vapor and the separation of the magnesium crown MC may be automatically carried out as described above, but there is still a problem in that the magnesium vapor flows into the condenser 633 in a state in which the condenser is positioned at the position for removing the magnesium crown, as illustrated in FIG. 14.

That is, there are problems in that in a state in which the condenser 633 is moved to the position for removing the magnesium crown, the inlet pipe 631 remains opened, and the magnesium vapor flows into the magnesium collecting chamber 632 through the inlet pipe 631, such that the inside of the magnesium collecting chamber 632 is contaminated, and condensation occurs in equipment of other parts.

These problems not only increase consumption of the magnesium vapor, but also cause additional problems in that an amount of time is required to clean the condensing device 60, processing costs are incurred, and failure occurs in other parts, thereby increasing production time and degrading production efficiency.

Therefore, a multi-type magnesium condensing system 700 according to the exemplary embodiment of the present invention controls a flow of the magnesium vapor using the control unit 630 that controls a magnesium vapor movement direction in accordance with operating situations of the plurality of condensing devices 60, thereby preventing production efficiency from deteriorating, by using an automated configuration of the condensing device 60.

Figure 17:
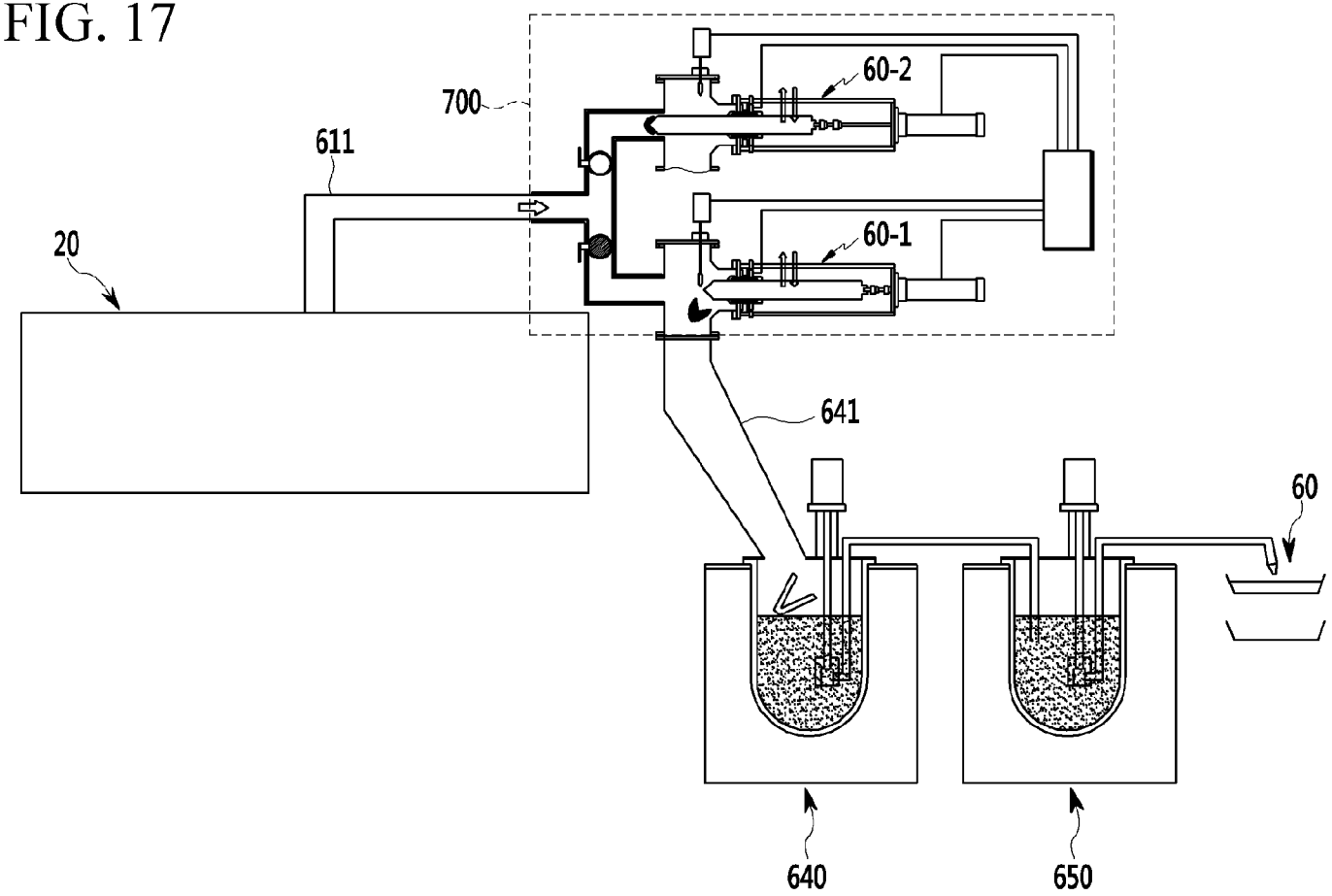
FIG. 17 is a configuration diagram of a thermal reduction apparatus to which a plurality of condensing devices according to the exemplary embodiment is applied.

FIG. 17 schematically illustrates a configuration of the multi-type magnesium condensing system according to the present exemplary embodiment. As illustrated in FIG. 17, the present exemplary embodiment establishes the multi-type magnesium condensing system 700 including two or more condensing devices 60, and discharges the magnesium crowns from the plurality of condensing devices 60, thereby increasing a production rate.

Hereinafter, throughout the specification, the condensing devices 60 are designated as a first condensing device 60-1 and a second condensing device 60-2 when the condensing devices 60 are separately described, otherwise the condensing devices 60 are collectively called the condensing device 60. Hereinafter, throughout the specification, a configuration of each condensing device, performing the same function in the above-stated exemplary embodiment uses the same reference numerals, but "−1" will be used of the end of reference numeral of a configuration of the first condensing device and "−2" will be used at the end of reference numeral of a configuration of the second condensing device in the drawings to distinguish between the above-stated description and the following description.

Figure 18:
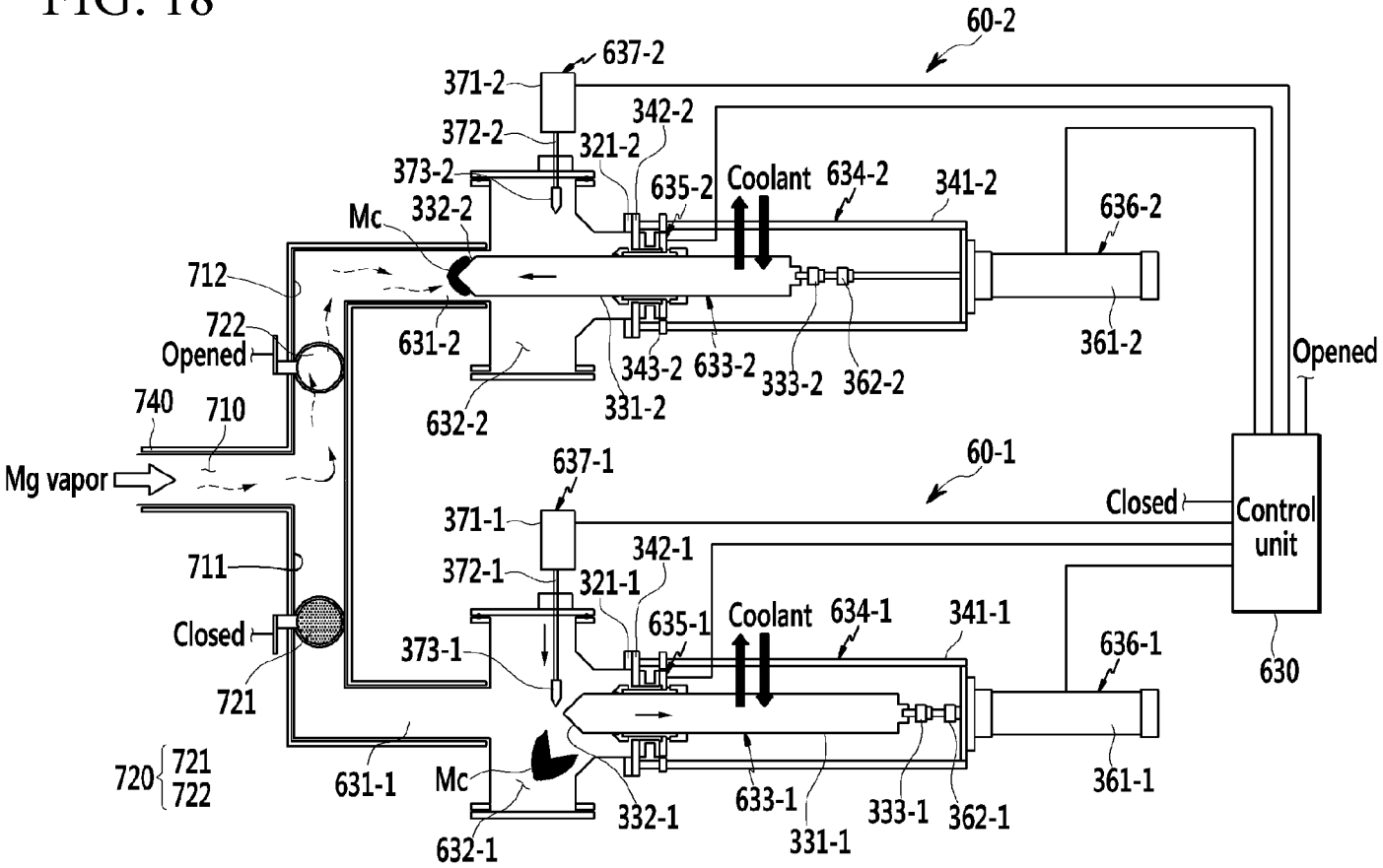
FIG. 18 is a configuration diagram schematically illustrating a configuration of a multi-type condensing system according to the exemplary embodiment.

Referring to the attached FIG. 18, the multi-type magnesium condensing system 700 according to the present exemplary embodiment includes: a plurality of condensing devices 60 which are independently separated; branch pipes 710 which supply the plurality of condensing devices 60 with magnesium vapor flowing from a magnesium vapor discharge pipe 611; control valves 720 which are installed in respective branch pipes 711 and 712 and control flows of the magnesium vapor; and a control unit 630 which controls an overall operation of the magnesium condensing system 700.

When the magnesium vapor flows in from a magnesium vapor supply pipe 611 connected to one end of the branch pipe 710, the branch pipe 710 supplies the magnesium vapor to the first condensing device 60-1 and the second condensing device 60-2 through the first branch pipe 711 and the second branch pipe 712.

In this case, a heater 740 is installed on an outer circumferential surface of the branch pipe 710 and heats the magnesium vapor flowing into the inlet pipe 631.

The control valves 720 include: a first control valve 721 which allows the magnesium vapor to pass through the first branch pipe 711 or blocks the magnesium vapor from passing through the first branch pipe 711 depending on a control signal applied from the control unit 630; and a second control valve 722 which allows the magnesium vapor to pass through the second branch pipe 712 or blocks the magnesium vapor from passing through the second branch pipe 712.

The control valve 720 is configured as a vacuum valve, thereby adjusting a flow rate of the magnesium vapor passing through the control valve 720 in accordance with an opening degree. However, the configuration of the control valve 720 is not limited to the vacuum valve, and any publicly known valve which has heat resistance and may open and close a flow path may be used.

The control unit 630 controls opened and closed states of the control valves 720 in accordance with whether condensing processes are carried out in the respective condensing devices 60, thereby adjusting a movement direction of the magnesium vapor.

For example, when a condenser 633 of the condensing device 60 is positioned at a condensing position for condensing the magnesium vapor, the control unit 630 determines that the condensing process is being carried out, and opens the control valve 720 to control the magnesium vapor to flow along the branch pipe 710.

In contrast, when the condenser 633 of the condensing device 60 is not positioned at the condensing position or a process of removing (separating) the magnesium crown is carried out, the control unit 630 determines that the condensing process is not carried out at present, and closes the control valve 720 to block the magnesium vapor from flowing into the condensing device 60.

A method of controlling the multi-type magnesium condensing system 700, which is based on the configurations according to the aforementioned exemplary embodiment, will now be described with reference to FIG. 19.

Figure 19:
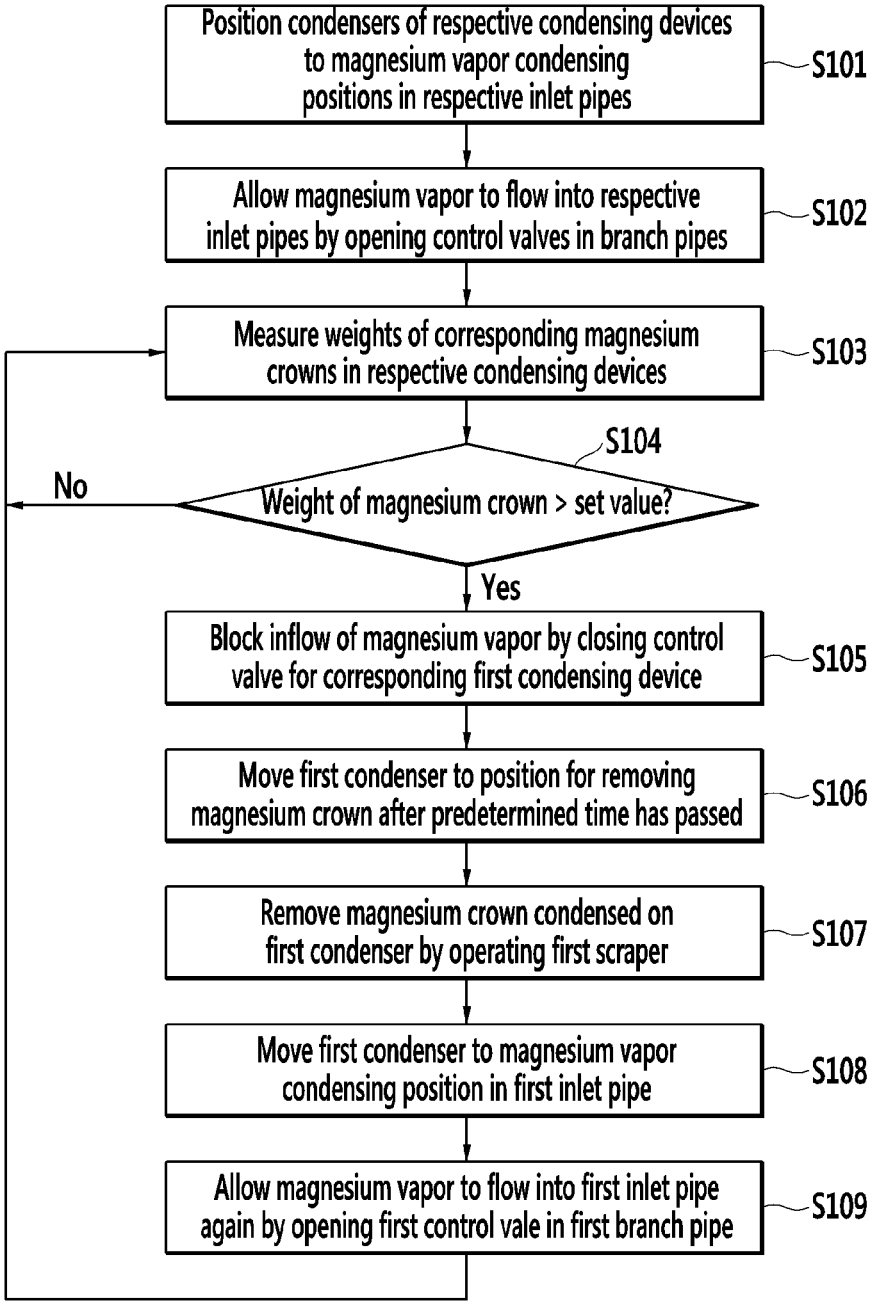
FIG. 19 is a flowchart schematically illustrating a method of controlling the multi-type condensing system according to the exemplary embodiment.

FIG. 19 is a flowchart schematically illustrating a method of controlling the multi-type magnesium condensing system according to the present exemplary embodiment.

Figure 20:
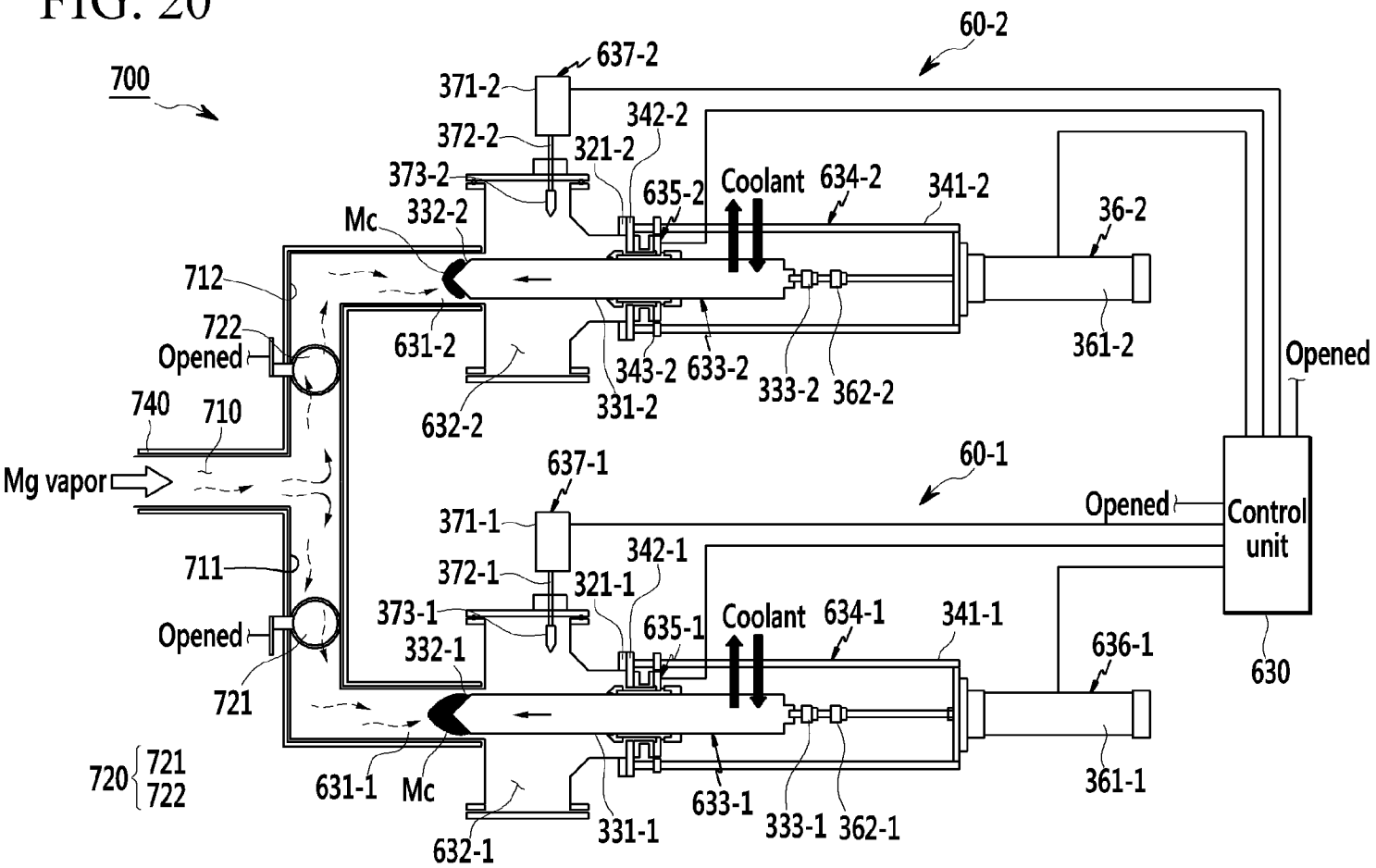
FIG. 20 is a view illustrating a state in which magnesium vapor flows into all of the plurality of condensing devices according to the exemplary embodiment.

FIG. 20 illustrates a state in which the magnesium vapor flows into all of the plurality of condensing devices according to the present exemplary embodiment.

Referring to the attached FIG. 19, in the multi-type magnesium condensing system 700 according to the present exemplary embodiment, the condensers 633 of the plurality of condensing devices 60 are positioned at the magnesium vapor condensing positions in the respective inlet pipes 631 (S101).

The multi-type magnesium condensing system 700 opens all of the control valves 720 installed in the branch pipe 710 and allows the magnesium vapor to flow into the respective inlet pipes 631 (S102, see FIG. 20).

Here, the multi-type magnesium condensing system 700 has a merit in that the condensing processes may be simultaneously carried out in the plurality of condensing devices 60. However, it is important that condensing periods are set to be different from each other, and as a result, the condensing process and the process of removing the magnesium crown are continuously and alternately carried out. This may be achieved by adjusting the control valve 720 to vary points of time at which the magnesium vapor begins to flow in among the plurality of condensing devices 60, or by varying opening degrees of the control valves 721 and 722 to adjust a period of time for which the condensing process is carried out.

The multi-type magnesium condensing system 700 measures the weights of the corresponding magnesium crowns MC in the condensing devices 60 when the magnesium vapor flowing into the respective inlet pipes 631 is condensed in the form of the magnesium crowns MC on the magnesium condensing units 332 of the condensers 633 (S103).

When the weight of the magnesium crown MC, which is measured in any one of the condensing devices 60, exceeds a set value (S104; Yes), the multi-type magnesium condensing system 700 closes the control valve 720 and blocks inflow of the magnesium vapor in order to perform the process of removing the magnesium crown MC from the corresponding condensing device 60 (S105).

Hereinafter, for convenience of description, it is assumed that the weight of the magnesium crown MC, which is measured in the first condensing device 60-1, exceeds a set value, so that the first control valve 721 is closed, and the magnesium vapor is blocked from flowing through the first branch pipe 711 (see FIG. 18).

The multi-type magnesium condensing system 700 moves a first condenser 633-1 to the position for removing the magnesium crown after a predetermined time has passed in order to condense residual magnesium vapor remaining in the first branch pipe 711 (S106). That is, the multi-type magnesium condensing system 700 is on standby until all residual magnesium vapor which remains in the first branch pipe 711 in which the first valve 721 is closed is consumed while being condensed, thereby preventing internal contamination caused by the residual magnesium vapor flowing into the system after the condenser is moved to the position for removing the magnesium crown.

When the first condenser 633-1 is moved to the position for removing the magnesium crown, the multi-type magnesium condensing system 700 operates a first scraper 637-1 to remove the magnesium crown MC condensed at the tip of the first condenser 633-1 (S107).

When the magnesium crown MC is completely removed, the multi-type magnesium condensing system 700 moves the first condenser 633-1 to the condensing position in a first inlet pipe 631-1 (S108).

Further, the multi-type magnesium condensing system 700 opens the first control valve 721 in the first branch pipe 711 to allow the magnesium vapor to flow into the first inlet pipe 631-1 again (S109).

Thereafter, the multi-type magnesium condensing system 700 returns back to step S103 and measures the weights of the magnesium crowns in the respective condensing devices 60, and although omitted in the drawing, when the weight of the magnesium crown in the second condensing device 60-2 exceeds the set value, the multi-type magnesium condensing system 700 may alternately perform steps S105 to S109.

As described, according to the exemplary embodiment of the present invention, by using the plurality of condensing devices, the magnesium vapor is condensed and the magnesium vapor is controlled by the control valve so as to flow only into the condensing device in which the condensing process is being carried out, thereby preventing contamination in the condensing device and reducing consumption of the magnesium vapor.

In addition, the plurality of condensing devices alternately and continuously perform the condensing process and the process of removing the magnesium crown, thereby improving efficiency in producing the magnesium crown.

In the aforementioned exemplary embodiment, the multi-type magnesium condensing system 700 has the plurality of condensing devices 60 that are independently separated from each other, but the plurality of condensing devices 60 may be integrally configured in a single chamber.

Figure 21:
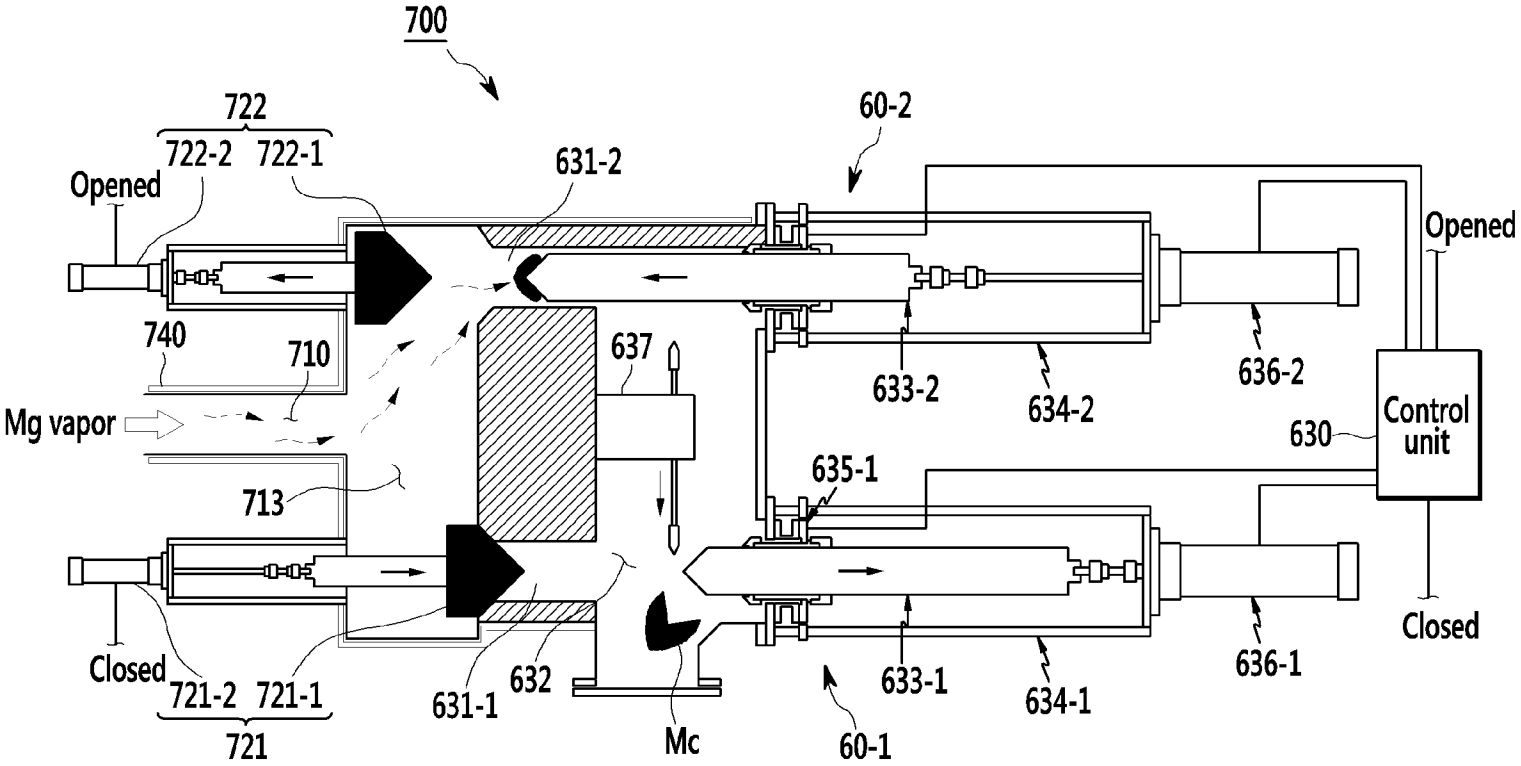
FIG. 21 is a view illustrating a configuration of a multi-type magnesium condensing system according to another exemplary embodiment.

FIG. 21 illustrates a configuration of a multi-type magnesium condensing system according to another exemplary embodiment of the present invention.

Referring to the attached FIG. 21, because the multi-type magnesium condensing system 700 according to the present exemplary embodiment has the same basic configuration and operating principle as the aforementioned exemplary embodiment, the differences between the exemplary embodiments will be mainly described.

In the multi-type magnesium condensing system 700, the plurality of condensing devices 60 are integrally configured in a magnesium collecting chamber 632, and the magnesium crown MC is supplied to the melting furnace 640 through a single shared magnesium crown discharge pipe 641.

A space unit 713, which covers a plurality of inlet pipes 631-1 and 631-2 that are configured in parallel, is formed at one side of the magnesium collecting chamber 632, thereby allowing the magnesium vapor to flow into each of the plurality of inlet pipes 631-1 and 631-2.

Further, control valves 721 and 722, which open and close inlets of the respective inlet pipes 631-1 and 631-2 while being moved rectilinearly in the form of a cylinder, are installed in the space unit 713 of the branch pipe 710, thereby controlling a movement direction of the magnesium vapor depending on an applied control signal.

The respective control valves 721 and 722 include: head portions 721-1 and 722-1 which are made of a refractory material and have a predetermined inclination identical to an inclination of the inlets of the inlet pipes 631-1 and 631-2; and rectilinear motion mechanisms 721-2 and 722-2 which move the head portions 721-1 and 722-1 rectilinearly in the form of a cylinder.

According to the exemplary embodiment of the present invention, it is possible to reduce a size of the entire facility by integrally configuring the plurality of condensing devices, and it is possible to reduce installation costs by sharing the magnesium collecting chamber 632 and the magnesium crown discharge pipe 641.

While the exemplary embodiments of the present invention have been described above, the present invention is not limited to the above exemplary embodiments, and may be variously changed.

For example, in the aforementioned exemplary embodiment of the present invention, the two condensing devices 60 are described for convenience of description, but the present invention is not limited thereto, and it is apparent that three or more condensing devices 60 may be provided.

In addition, the plurality of condensing devices 60 according to the aforementioned exemplary embodiment are described as being disposed vertically for convenience of description, but the present invention is not limited thereto, and the plurality of condensing devices 60 may be disposed in parallel horizontally, and for example, assuming that FIGS. 18 and 21 are top plan views, the magnesium crown MC may be unloaded at the bottom of the opposite side.

The exemplary embodiments of the present disclosure have been described with reference to the accompanying drawings, but those skilled in the art will understand that the present disclosure may be implemented in any other specific form without changing the technical spirit or an essential feature thereof.

Thus, it should be appreciated that the exemplary embodiments described above are intended to be illustrative in every sense, and not restrictive. The scope of the present invention is represented by the claims to be described below rather than the detailed description, and it should be interpreted that all the changes or modified forms, which are derived from the meanings and scope of the claims, and the equivalents thereto, are included in the scope of the present invention.

What is claimed is:

1. A thermal reduction apparatus comprising:

a preheating unit which preheats a to-be-reduced material;

a reducing unit which is connected to the preheating unit and in which a thermal reduction reaction of the to-be-reduced material occurs and comprising:

a reducing unit body which defines an internal space;

a first blocking membrane which is installed in the reducing unit body; and a second blocking membrane which is installed in the reducing unit so as to be spaced apart from the first blocking membrane, and the internal space of the reducing unit body is sequentially divided in a movement direction of the to-be-reduced material into a first space, a second space formed between the first blocking membrane and the second blocking membrane, and a third space;

a cooling unit which is connected to the reducing unit and from which the to-be-reduced material is unloaded to the outside;

a first gate valve which is installed between the preheating unit and the reducing unit;

a second gate valve which is installed between the reducing unit and the cooling unit;

a condenser which is connected to the reducing unit and condenses a metal vapor; and a loader which is installed at a lateral side of the preheating unit and includes a first drive cylinder which moves the to-be-reduced material from the preheating unit to the first space of the reducing unit body;

a moving unit including a second drive cylinder and a third drive cylinder, wherein the second drive cylinder is installed at a tip of the first space of the reducing unit body and pushes the to-be-reduced material to move to the first space by the loader toward the second space of the reducing unit body while being extended toward the second space, and the third drive cylinder is installed at a tip of the third space of the reducing unit body and draws the to-be-reduced material in the second space toward the third space while being extended toward the second space.

2. The thermal reduction apparatus of claim 1, wherein the preheating unit includes:

a preheating unit body which has a first opening through which the to-be-reduced material is loaded, and a second opening through which the to-be-reduced material, which is primarily preheated, is unloaded;

a first door which is openably and closably coupled to the first opening;

a vacuum device which is installed while penetrating one surface of the preheating unit body; and a temperature adjusting device which is installed in the preheating unit body and preheats the to-be-reduced material.

3. The thermal reduction apparatus of claim 1, wherein the cooling unit includes:

a cooling unit body into which the to-be-reduced material passing through the reducing unit flows;

a second door which is openably and closably coupled to the cooling unit body; and at least one vacuum device which is installed while penetrating one surface of the cooling unit body.

4. The thermal reduction apparatus of claim 1, wherein the preheating unit is disposed at a lateral side of the reducing unit with respect to the movement direction of the to-be-reduced material.

5. The thermal reduction apparatus of claim 1, further comprising a drawer which is installed at a lateral side of the third space of the reducing unit body and moves the to-be-reduced material moved to the third space toward the cooling unit.

6. The thermal reduction apparatus of claim 1, wherein the cooling unit is disposed at a lateral side of the reducing unit with respect to the movement direction of the to-be-reduced material, and the drawer moves the to-be-reduced material to the cooling unit through a lateral side of the third space of the reducing unit body.

* * * * *